US010422359B2

(12) United States Patent
Sergeev

(10) Patent No.: US 10,422,359 B2
(45) Date of Patent: Sep. 24, 2019

(54) TENSILE ACTUATOR

(71) Applicant: Alexander Sergeev, San Francisco, CA (US)

(72) Inventor: Alexander Sergeev, San Francisco, CA (US)

( * ) Notice: Subject to any disclaimer, the term of this patent is extended or adjusted under 35 U.S.C. 154(b) by 143 days.

(21) Appl. No.: 15/149,167

(22) Filed: May 8, 2016

(65) Prior Publication Data

US 2017/0037878 A1 Feb. 9, 2017

Related U.S. Application Data

(60) Provisional application No. 62/158,581, filed on May 8, 2015.

(51) Int. Cl.
*F15B 15/10* (2006.01)

(52) U.S. Cl.
CPC ..... *F15B 15/103* (2013.01)

(58) Field of Classification Search
CPC ..... F15B 15/103; F15B 15/10
USPC ..... 92/90–92
See application file for complete search history.

(56) References Cited

U.S. PATENT DOCUMENTS 4,819,547 A * 4/1989 Kukolj ..... F15B 15/103 92/153
5,529,293 A * 6/1996 Haugs ..... B63B 21/20 254/93 HP
9,464,642 B2 10/2016 Ilievski et al.
2002/0083828 A1* 7/2002 Bernier ..... F04B 9/10 92/92
2005/0081711 A1* 4/2005 Kerekes ..... B62D 35/005 92/48
2008/0183132 A1 7/2008 Davies et al.

* cited by examiner

*Primary Examiner* — Michael Leslie
*Assistant Examiner* — Daniel S Collins
(74) *Attorney, Agent, or Firm* — Patrick Reilly

(57) ABSTRACT

A method is disclosed wherein two sheets of a flexible, inelastic substance are sealed along a periphery thereof, creating an interior reservoir preferably containing two or more elongate chambers, organized normal to an axis of traction. The disclosed axis of traction is an axis along which the disclosed device reduces length as a compressed medium is introduced into the reservoir. Further disclosed is a method by which one or more bladders of flexible, inelastic substance are woven through two or more preferably parallel strips or strings. The bladders are adapted to receive a preferably gaseous or liquid compressed medium. As the compressed medium is moved into the bladders, the flexible strips or stings are deformed to cause the strips or strings to have a reduced length along the axis of traction.

17 Claims, 24 Drawing Sheets

TRUE SIDE VIEW — EXTENDED POSITION

TRUE SIDE VIEW, COMPRESSED POSITION

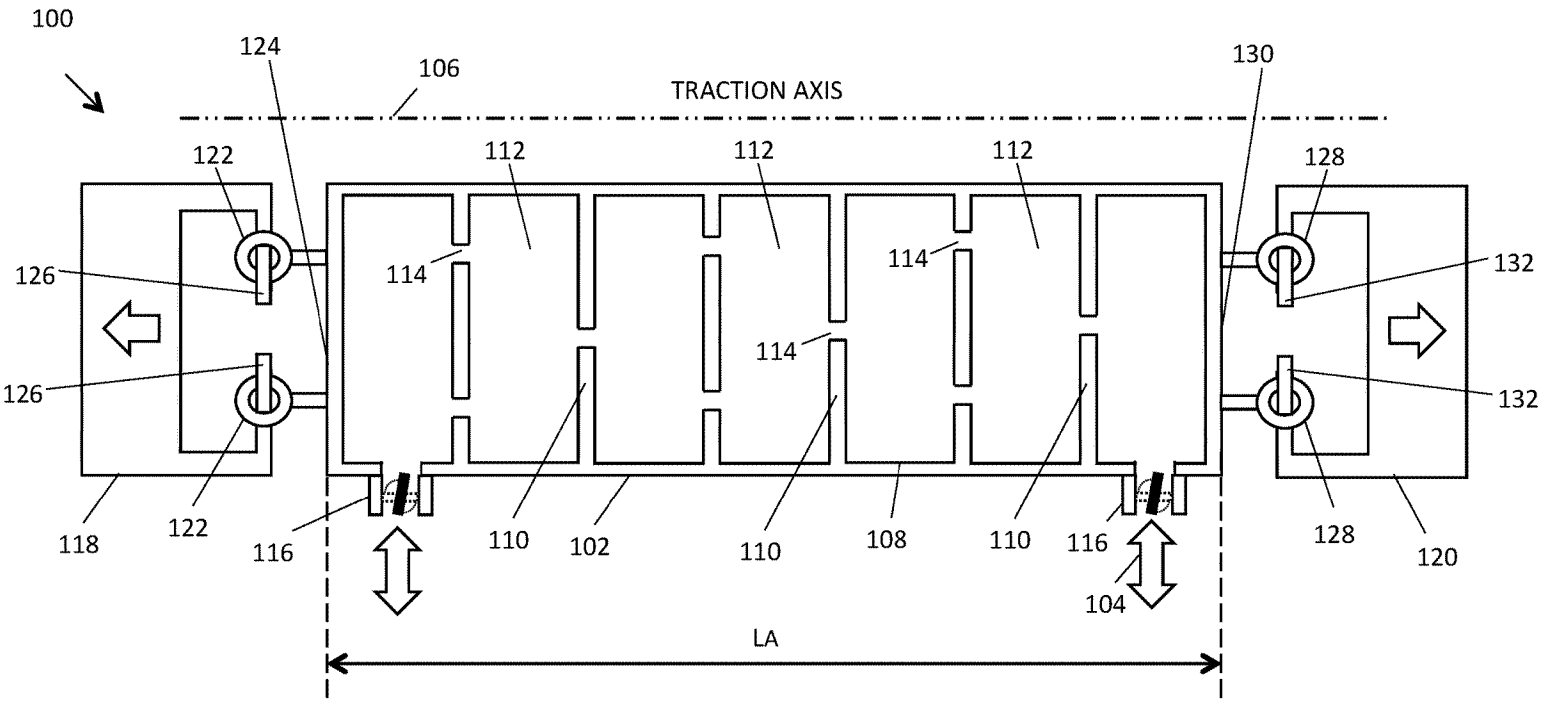
FIGURE 1A - TOP VIEW, EXTENDED

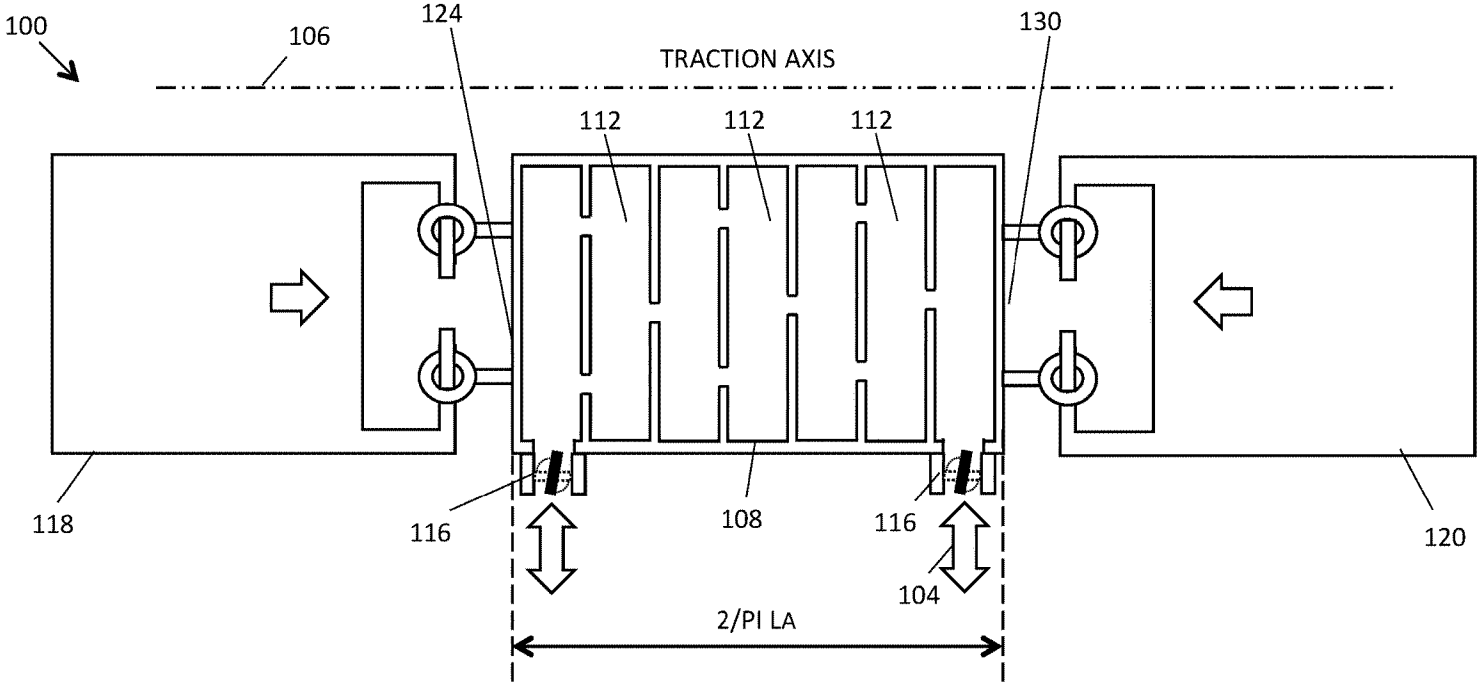
FIG 1B - TOP VIEW, FILLED

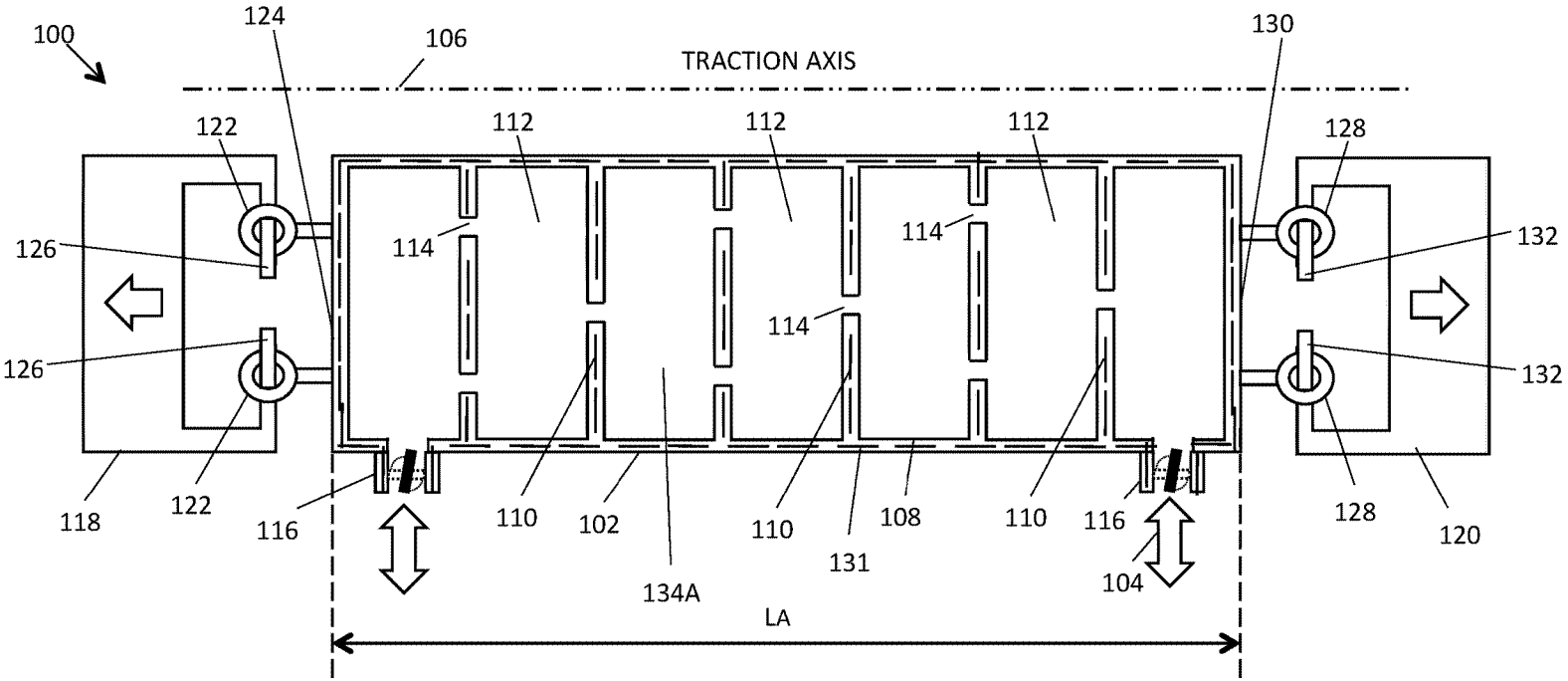
FIGURE 1C - TOP VIEW, TEXTILE, EXTENDED

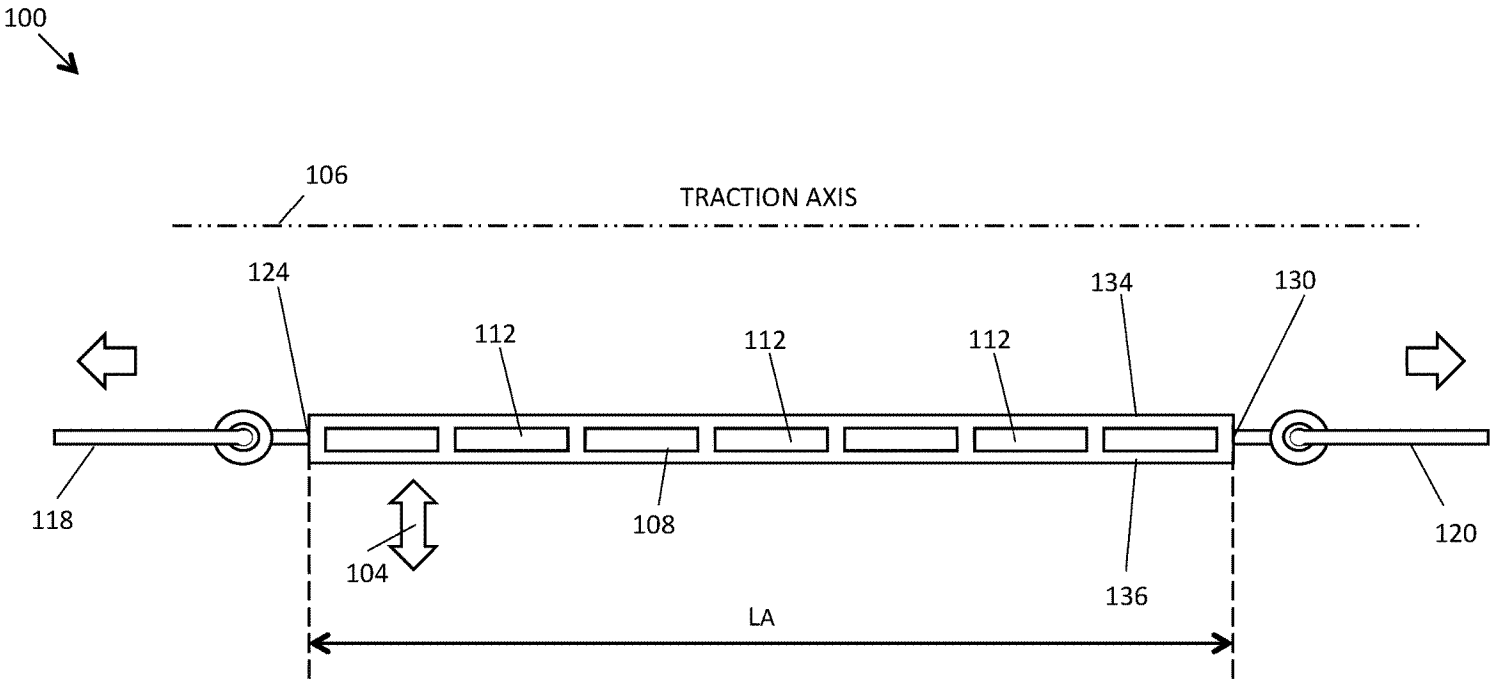
FIGURE 2A - SIDE VIEW EXTENDED

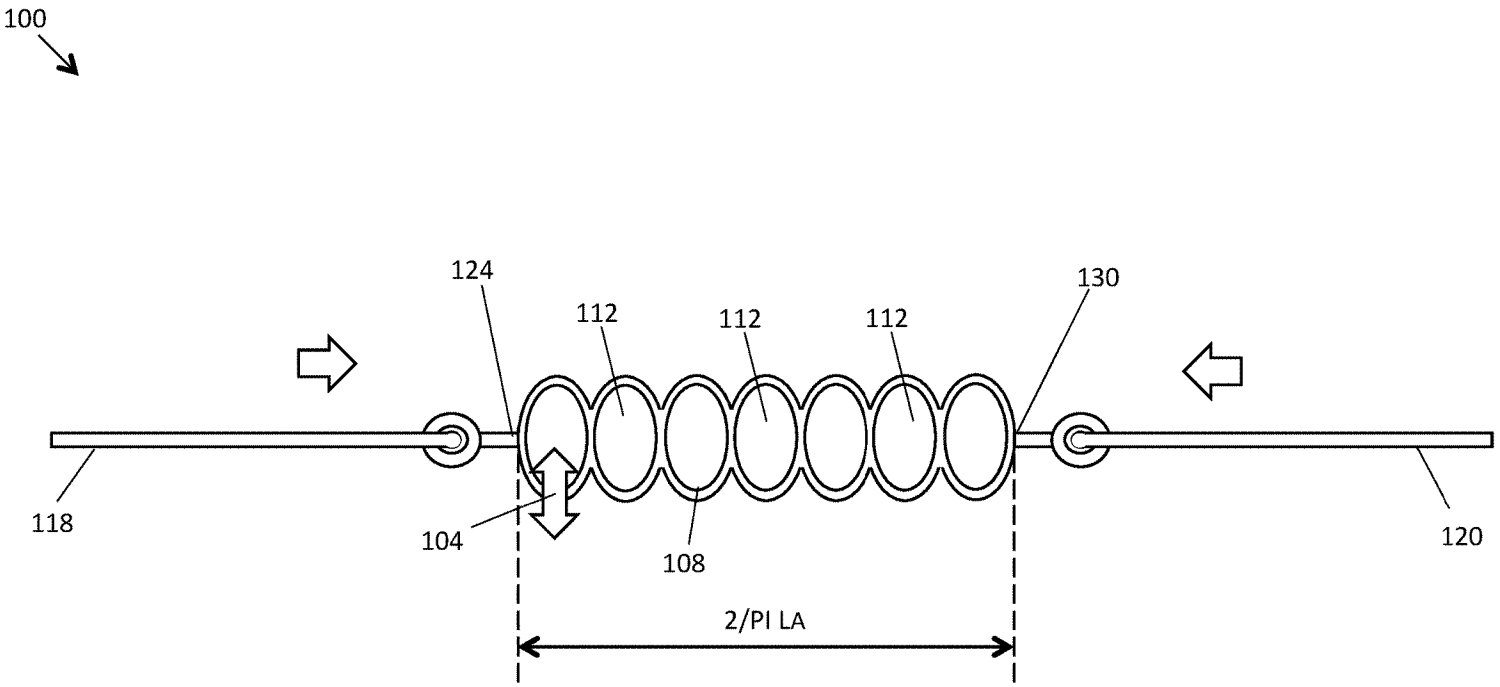
FIGURE 2B - SIDE VIEW, FILLED

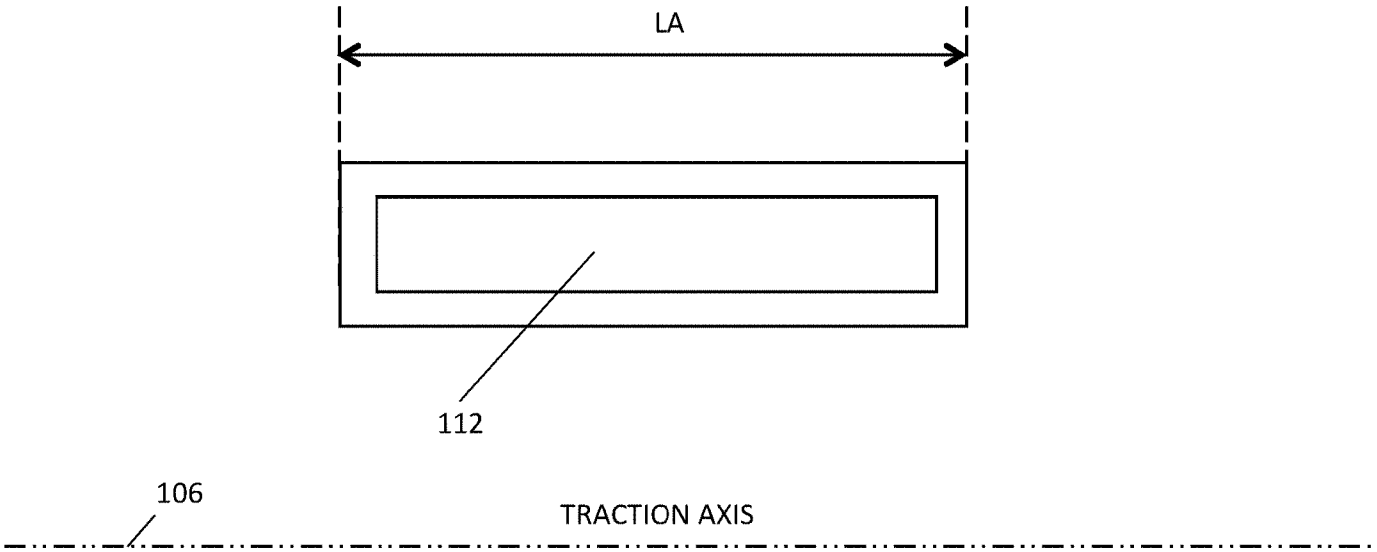
FIGURE 2C - DETAIL, SIDE VIEW, EXTENDED

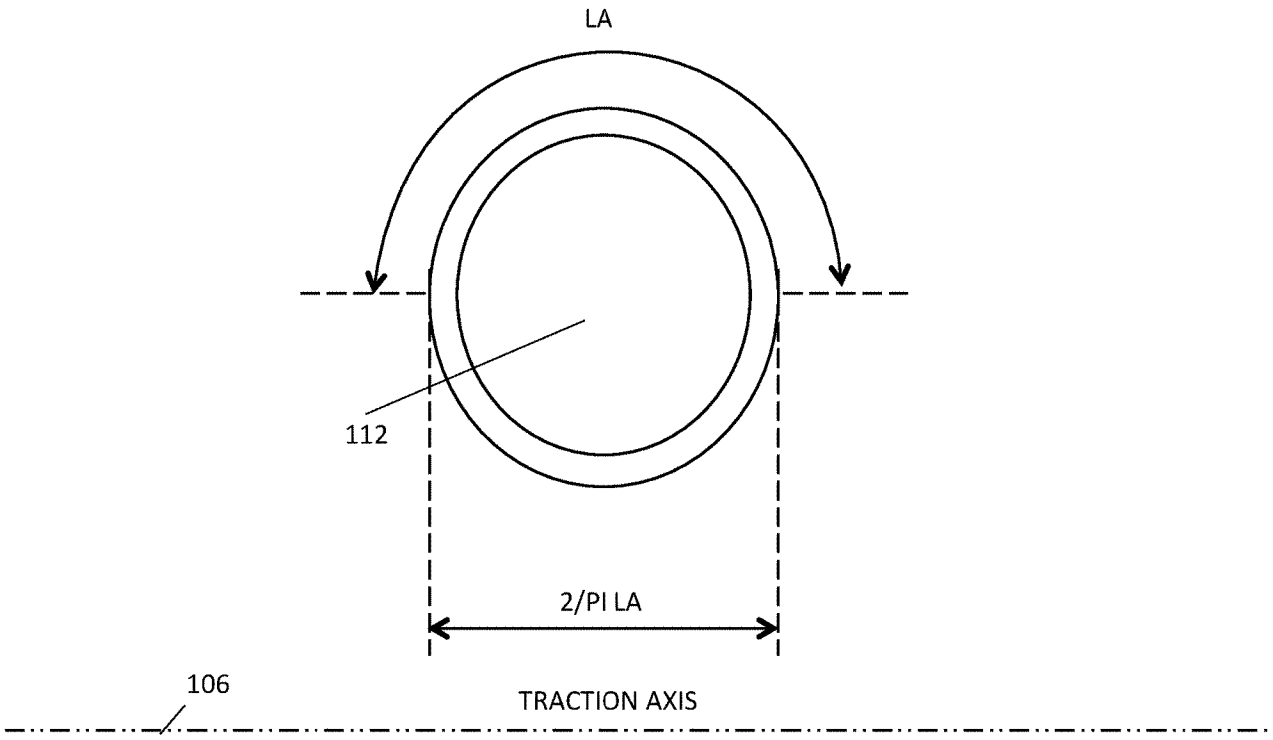
FIGURE 2D – DETAIL, SIDE VIEW, FILLED

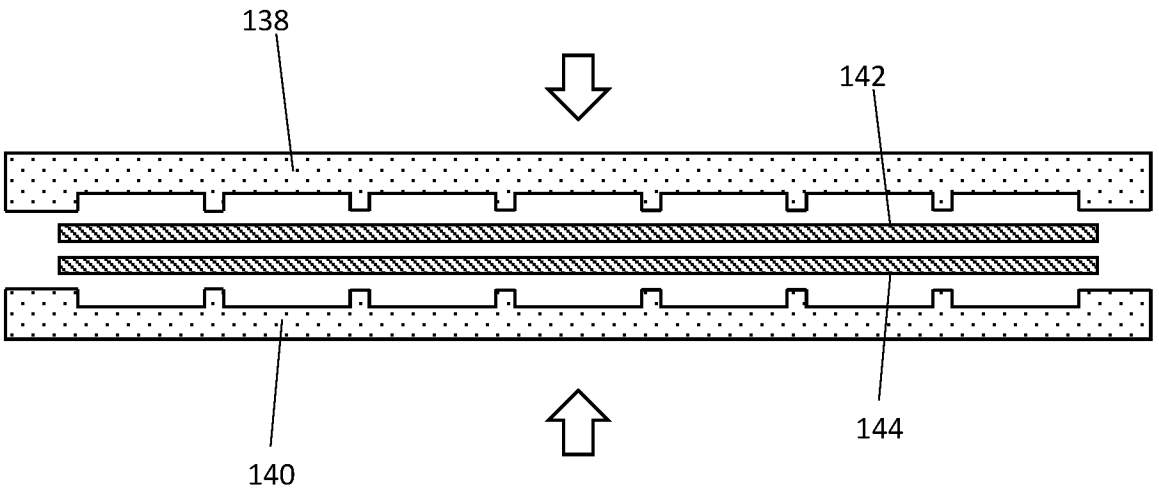
FIGURE 3A - DIE: SIDE W/PATTERN, BOTTOM W/ PATTERN

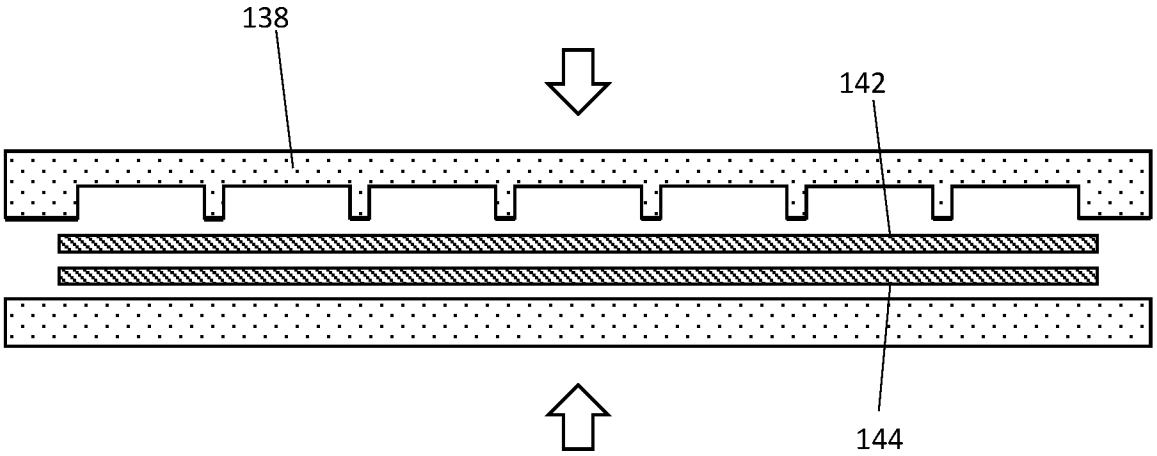
FIGURE 3B - DIE: SIDE W/PATTERN, BOTTOM BLANK

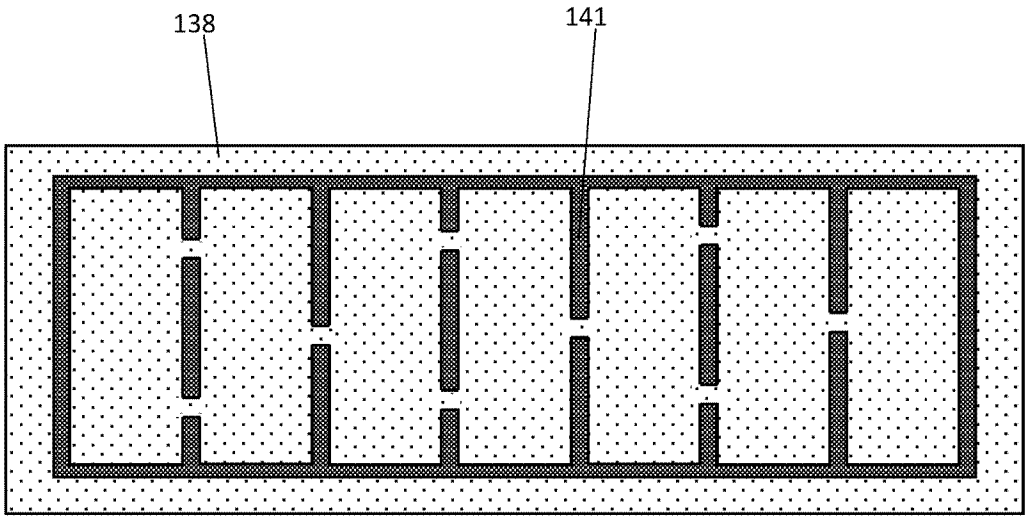
FIGURE 3C - DIE: TOP W/PATTERN

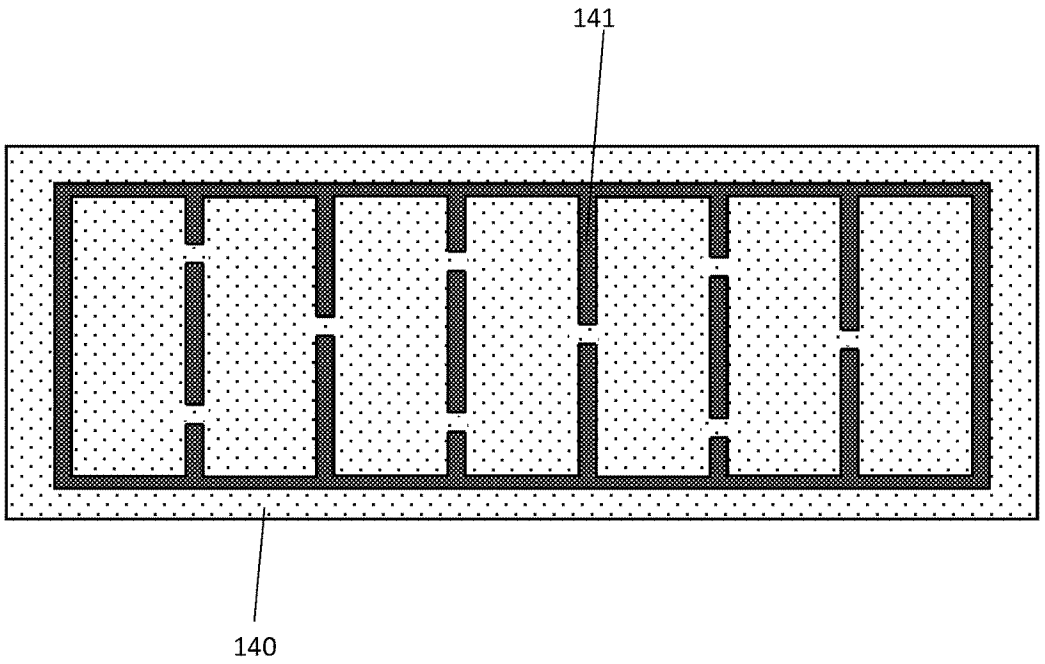
FIGURE 3D - DIE: BOTTOM W/PATTERN

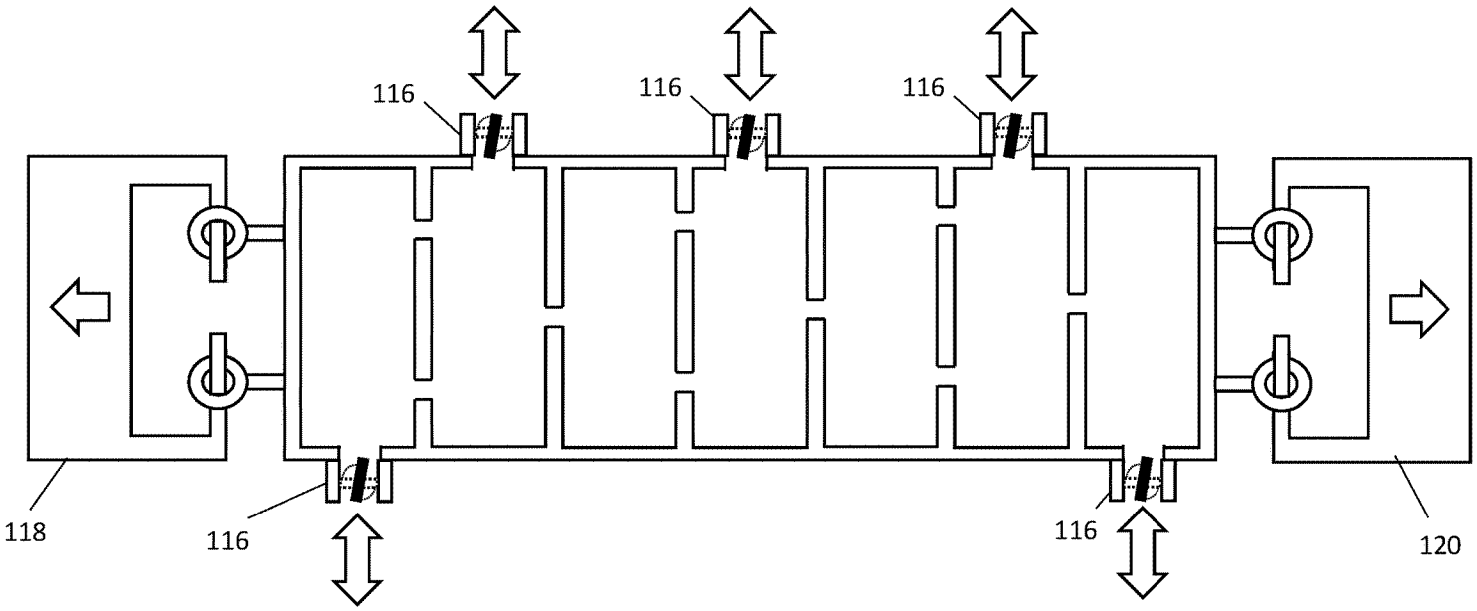
FIGURE 4 - MULTI-PORTS

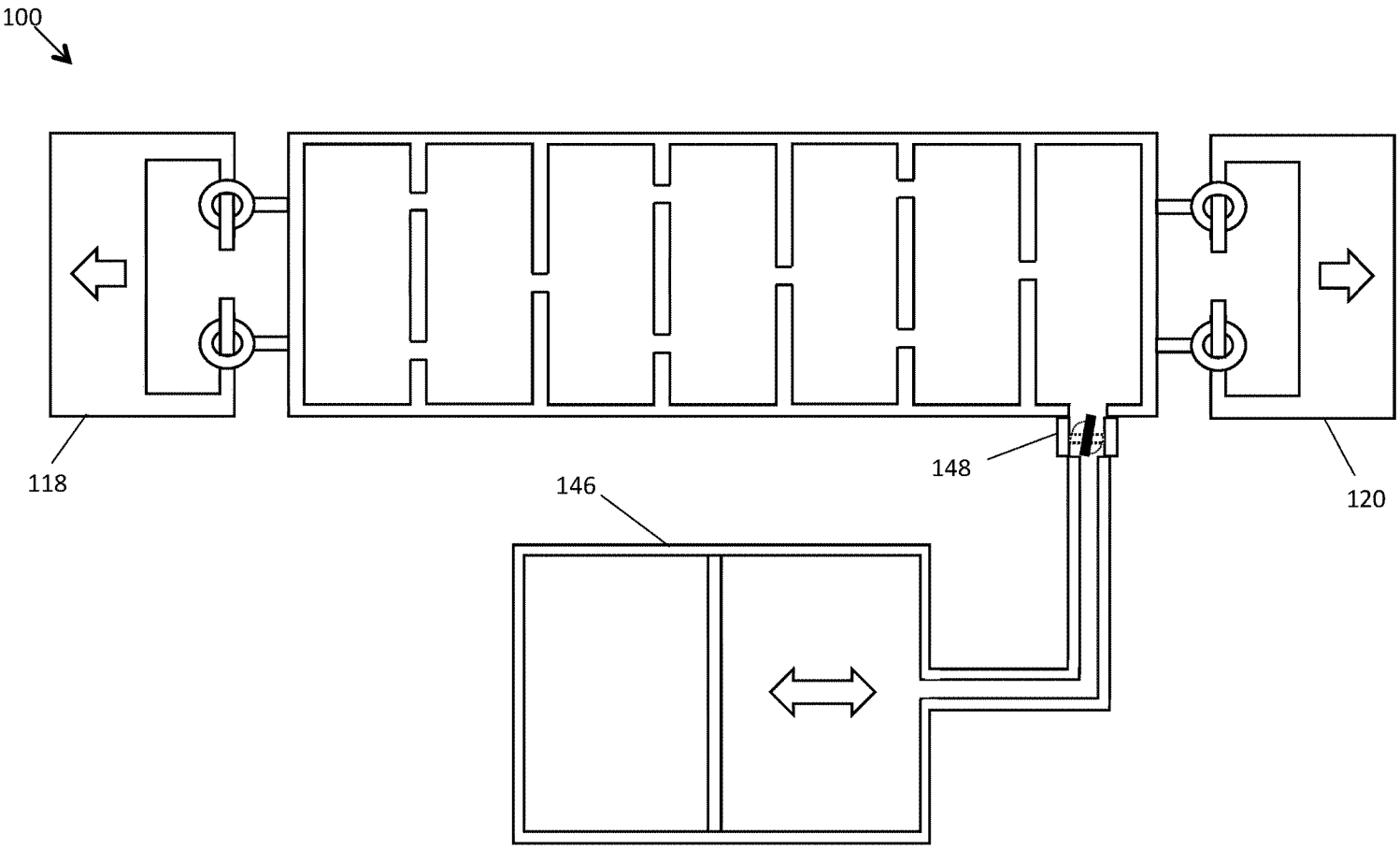
FIGURE 5A – RESERVOIR WITH PUMP

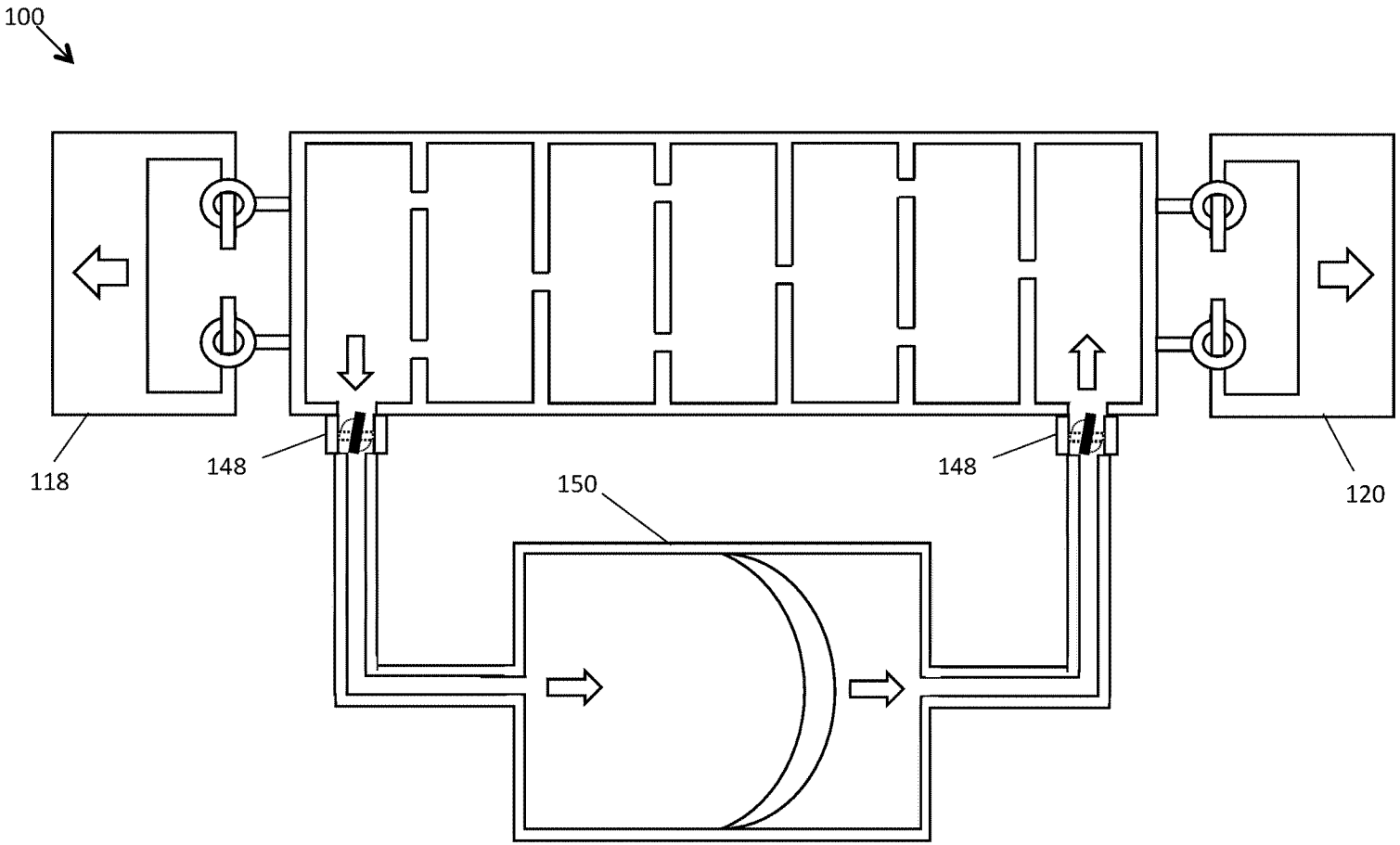
FIGURE 5B – RESERVOIR WITH A MEMBRANE

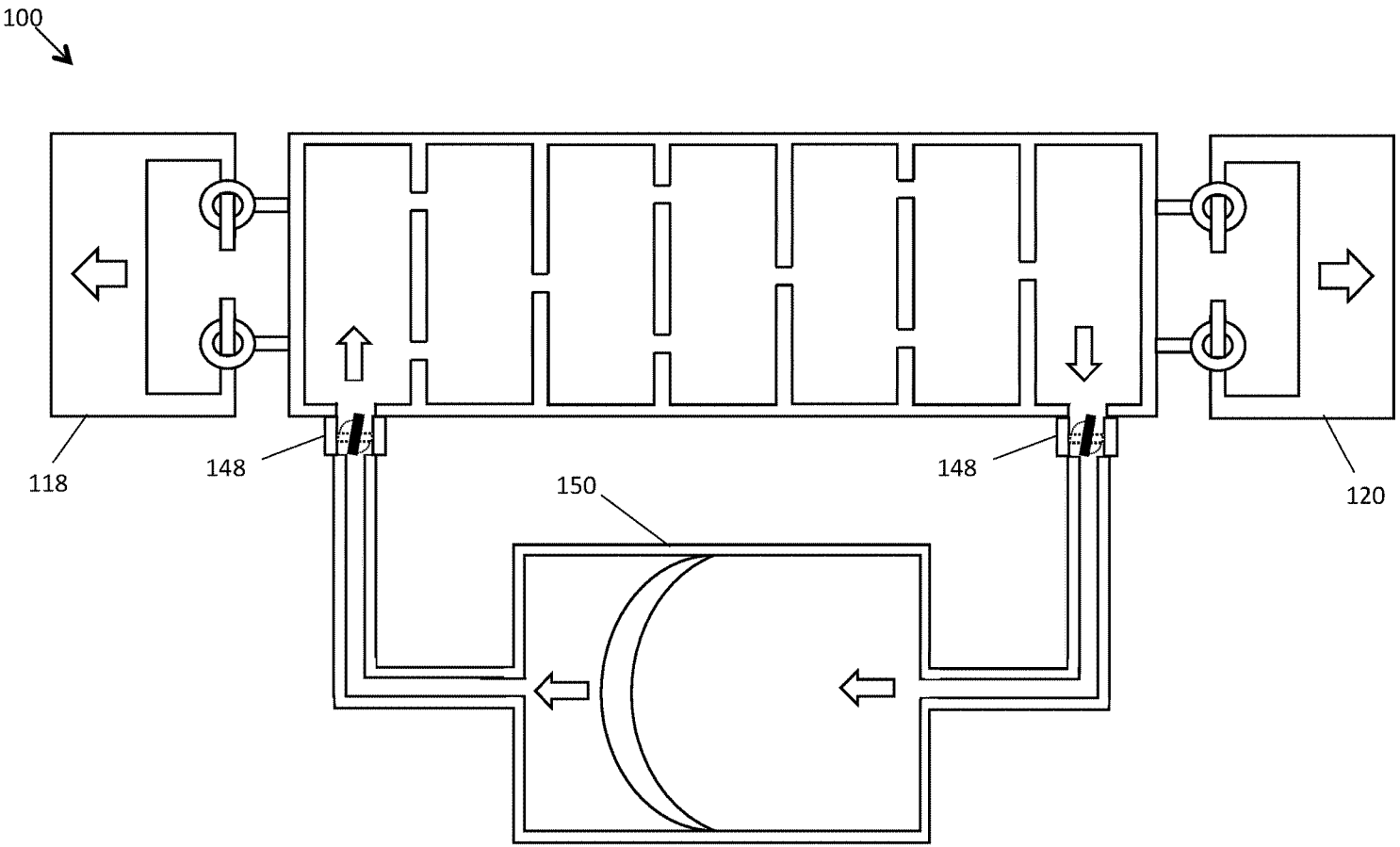
FIGURE 5C – RESERVOIR WITH A MEMBRANE

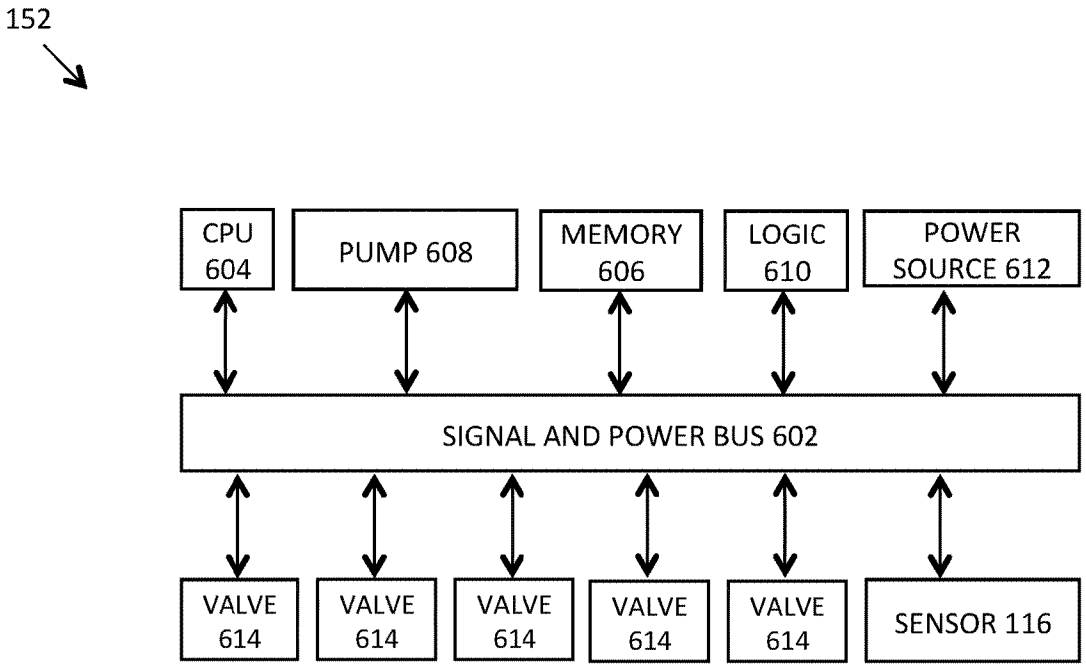
FIG 6 - CONTROL SCHEMATIC

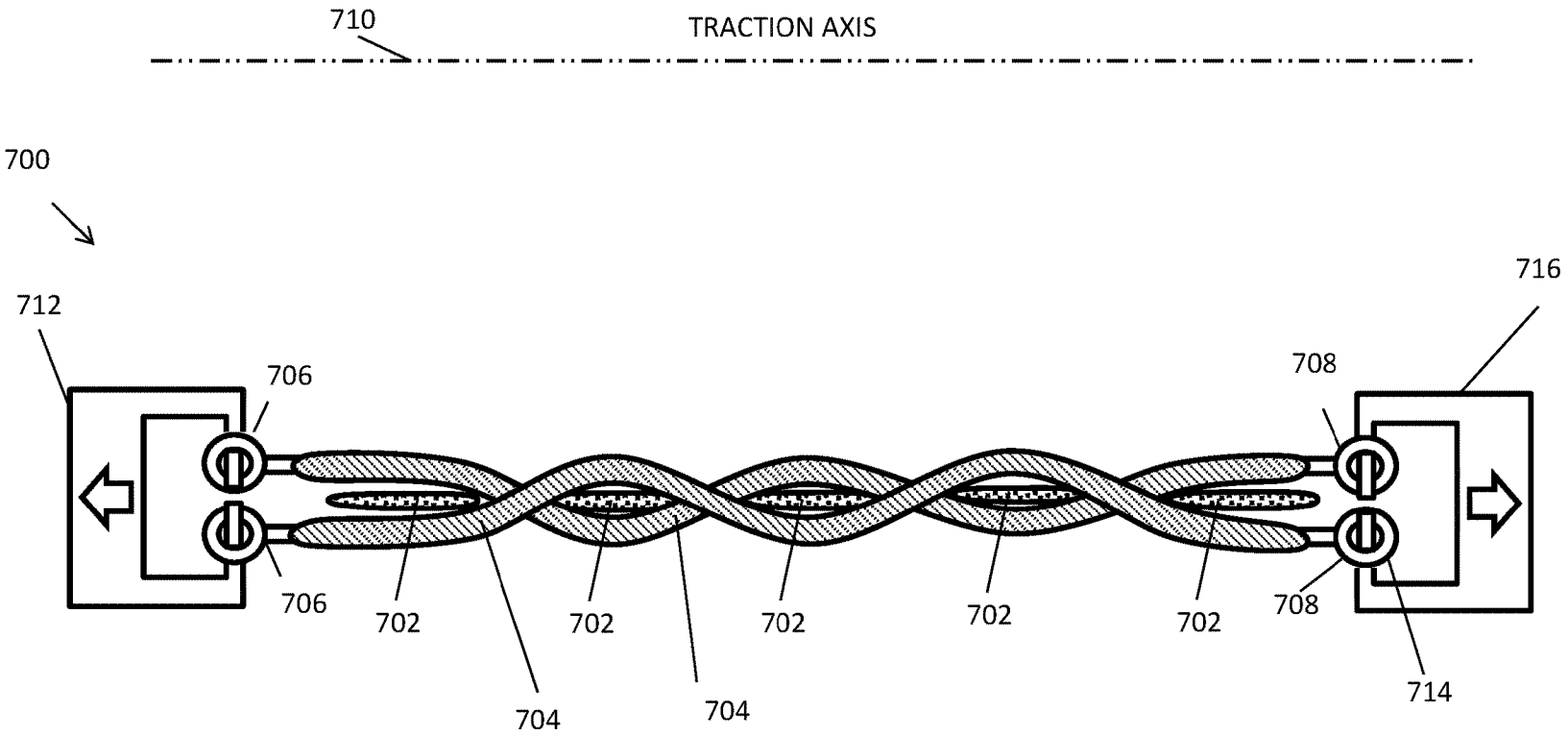
FIGURE 7A: TRUE SIDE VIEW — EXTENDED POSITION

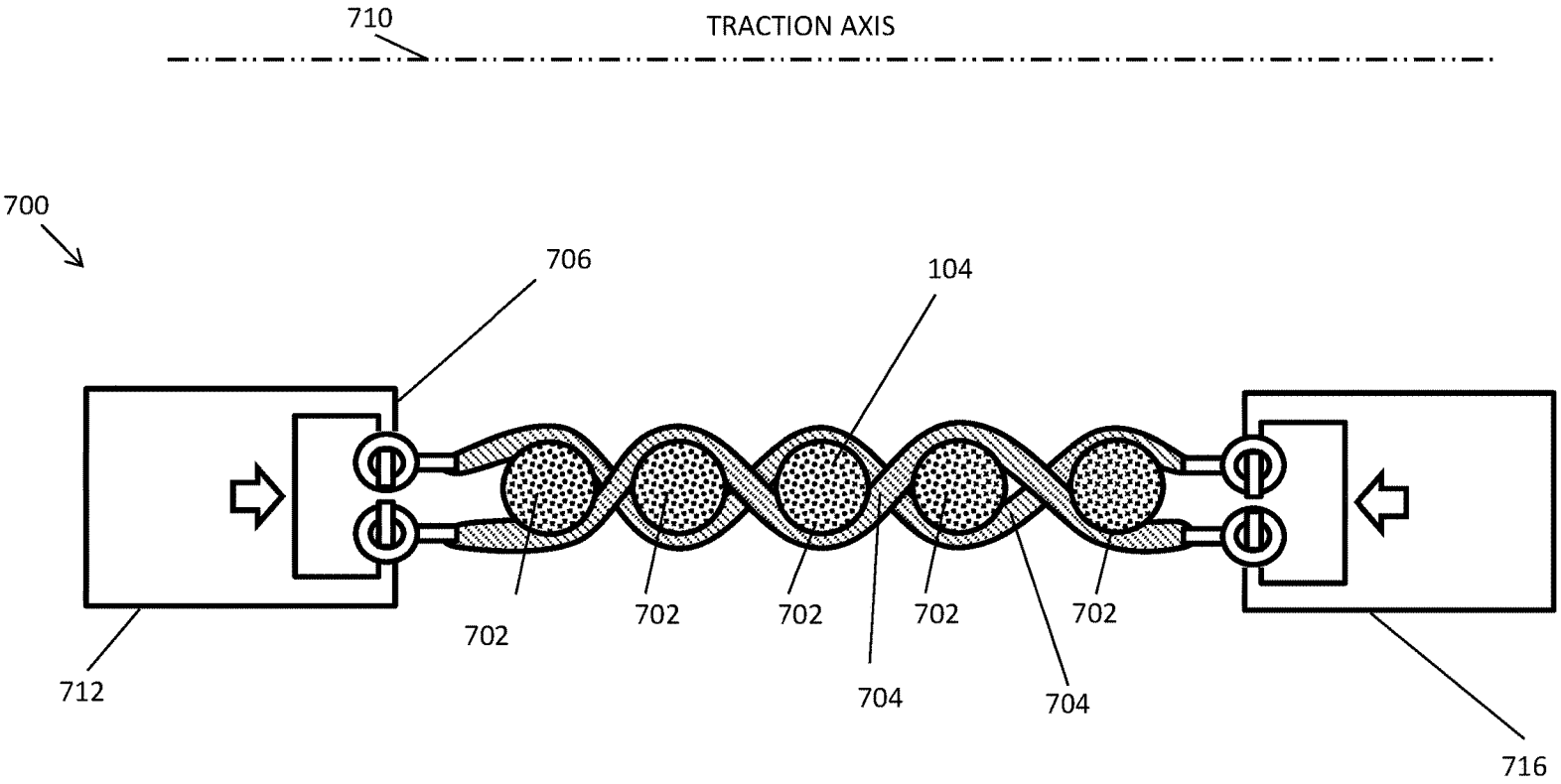
FIGURE 7B: TRUE SIDE VIEW, COMPRESSED POSITION

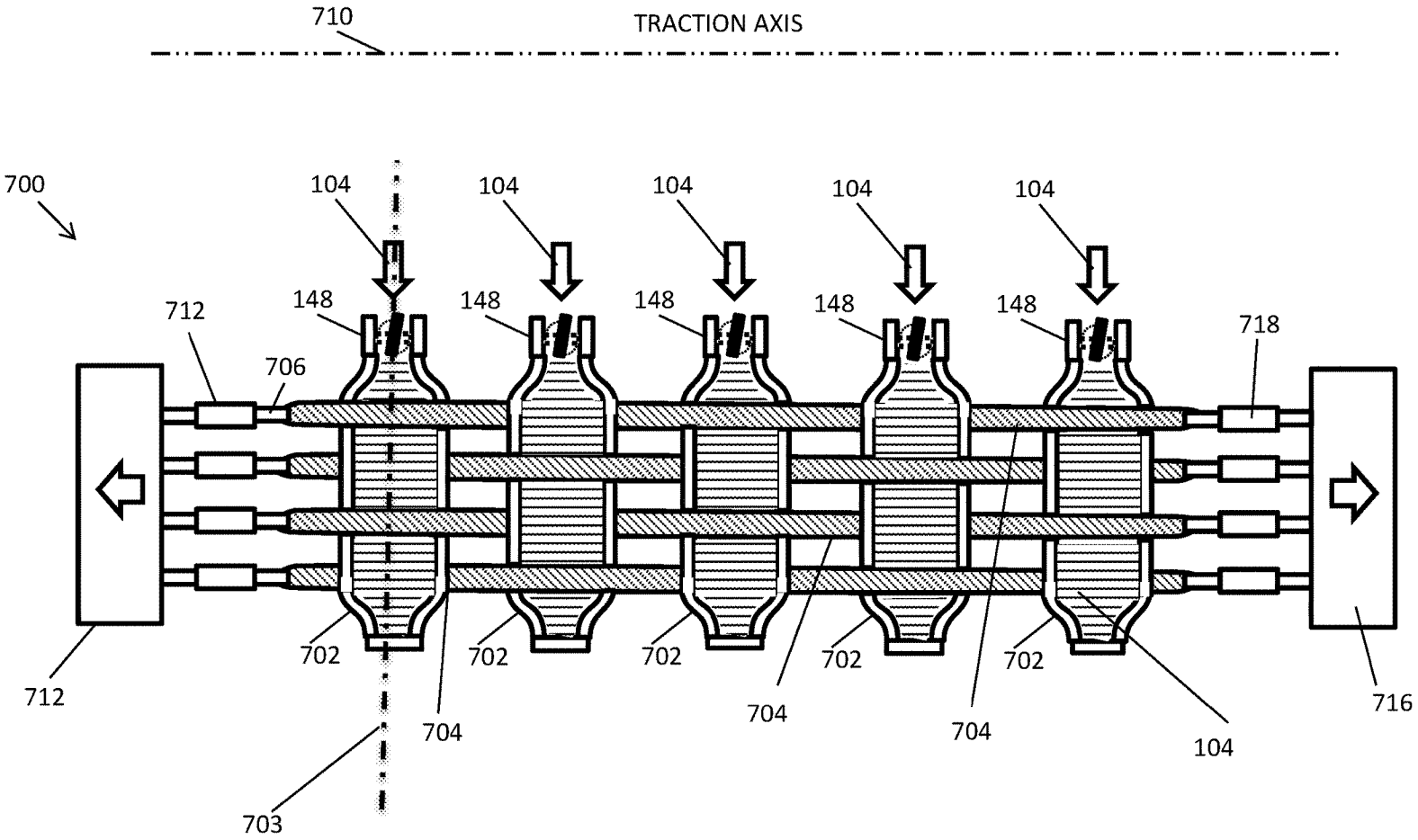
FIGURE 7C: TRUE TOP VIEW, EXTENDED POSITION

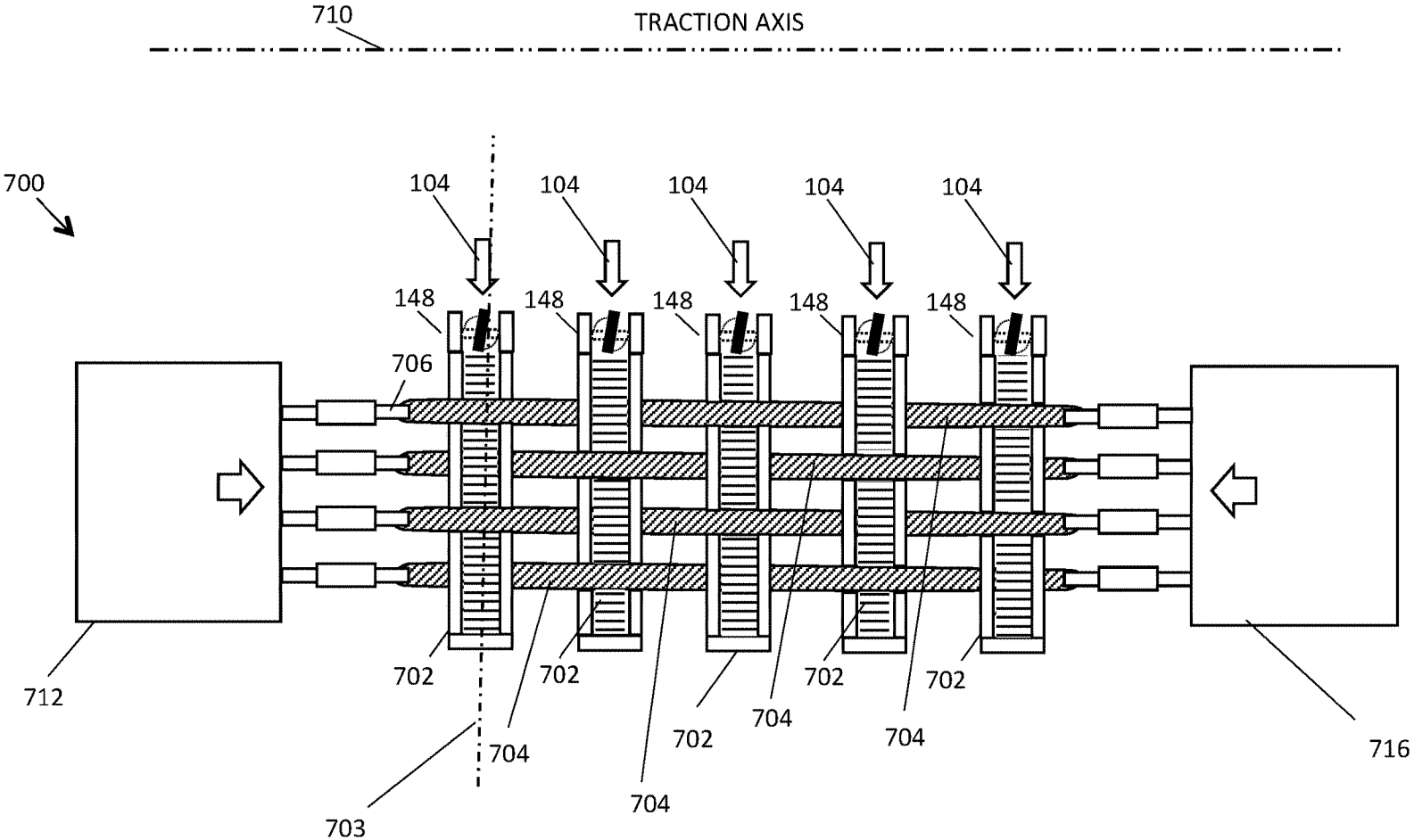
FIGURE 7D: TRUE TOP VIEW, COMPRESSED POSITION

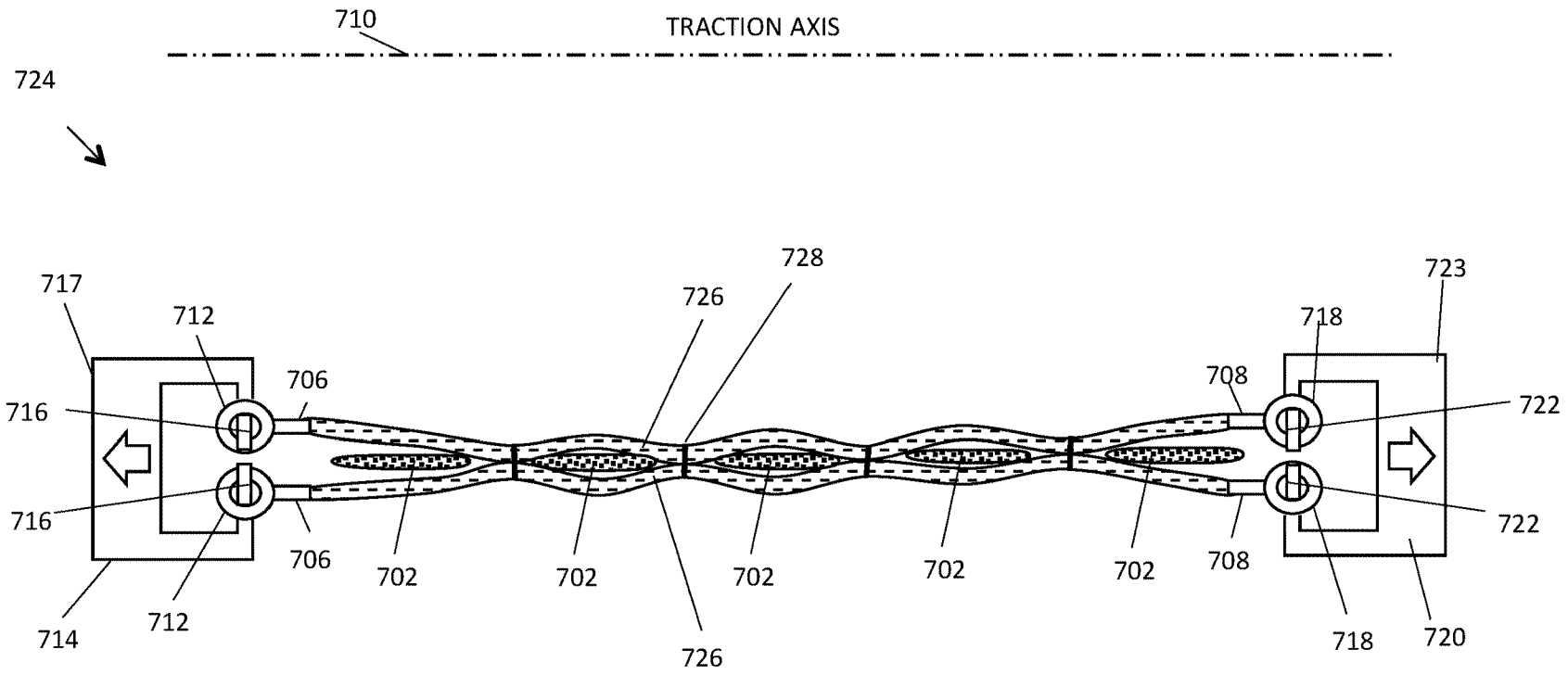
FIGURE 7E: TEXTILE MATERIAL, TRUE SIDE VIEW - EXTENDED POSITION

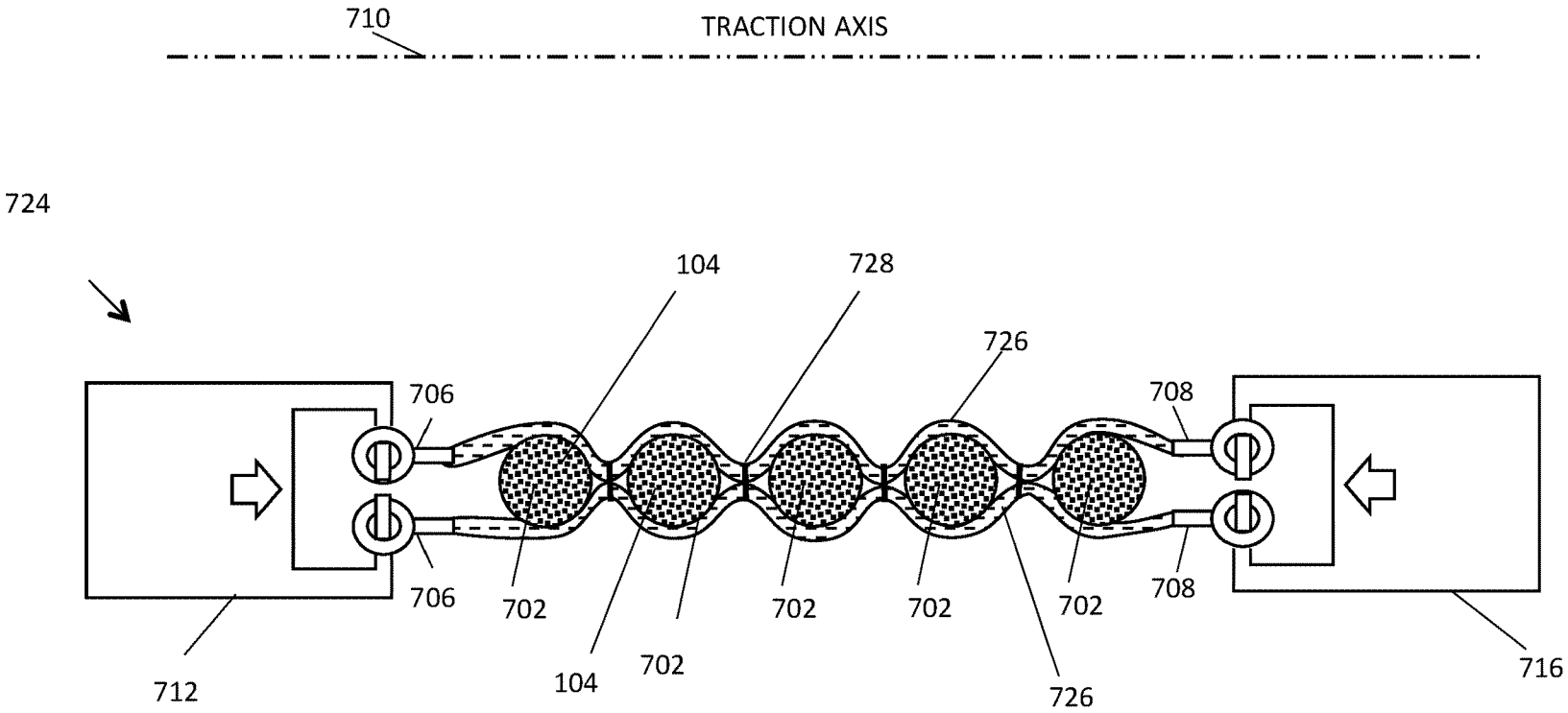
FIGURE 7F: TEXTILE MATERIAL, TRUE SIDE VIEW - COMPRESSED POSITION

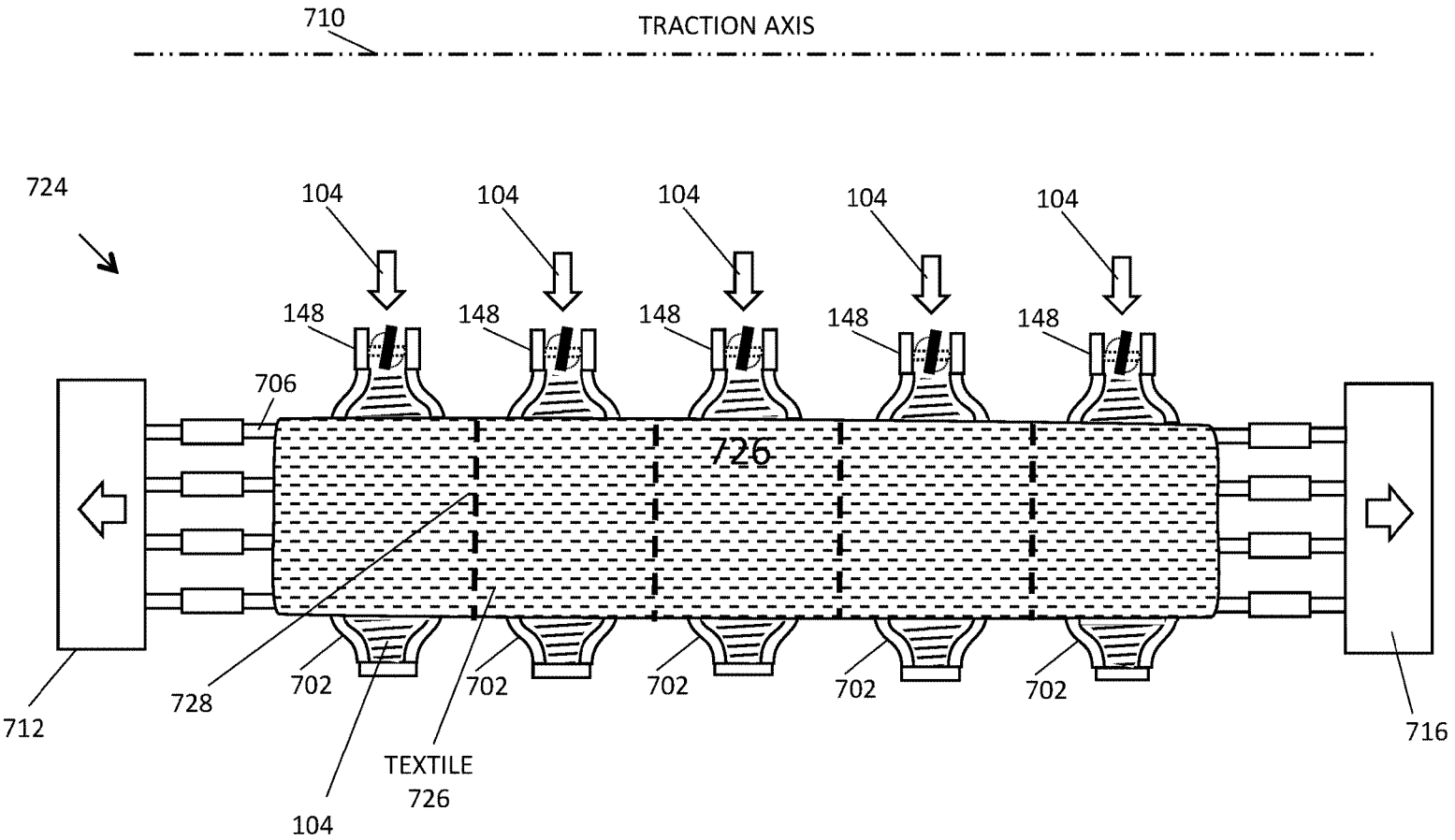
FIGURE 7G: TEXTILE MATERIAL, TRUE TOP VIEW, EXTENDED POSITION

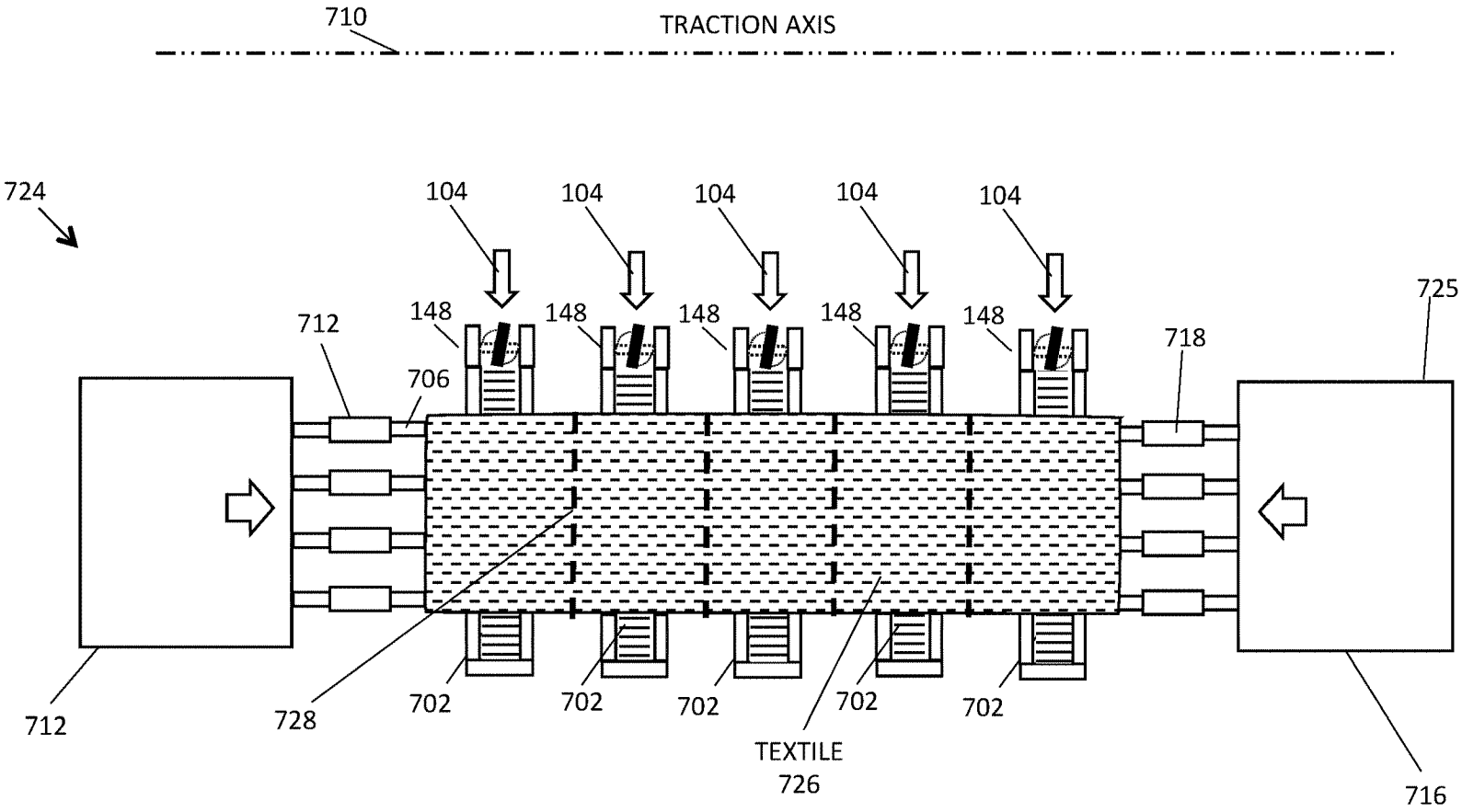
FIGURE 7H: TEXTILE MATERIAL, TRUE TOP VIEW, COMPRESSED POSITION

TENSILE ACTUATOR

CO-PENDING PATENT APPLICATION

This Nonprovisional Patent Application is a Continuation-in-Part Application to U.S. Provisional Patent Application Ser. No. 62/158,581 as filed on May 8, 2015 by Inventor Alexander Sergeev and titled TENSILE ACTUATOR.

FIELD OF THE INVENTION

The present invention relates to the field of mechanical actuators. More particularly, the present invention relates to actuators adapted for integration with control systems.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

The many possible applications for an electromechanical actuator which responds to the commands of a processor are both economically and scientifically valuable in the fields of robotics, prosthetics, and devices having physical memory. However, previous efforts made to mimic mammalian muscle function have proved inefficient in both cost and ease of production, and these inefficiencies have impeded the availability of such electromechanical actuators.

There is therefore a long-felt need to provide a method and system that provide increased efficiencies in the cost and availability of actuators which mimic muscle functions.

SUMMARY AND OBJECTS OF THE INVENTION

Towards these objects and other objects that will be made obvious in light of the present disclosure, a system and method are provided that enable a tensile actuator, whereby a tensile force is created by means of a compressed medium being introduced into a reservoir having elongate chambers, the compressed medium preferably consisting of either a gas or a liquid.

In a first preferred embodiment of the method of the present invention (hereinafter the "invented method"), two sheets of a flexible, inelastic substance are sealed together along the periphery thereof. An interior reservoir created by the sealing of the two flexible, inelastic sheets preferably contains two or more elongate chambers, within and between which the compressed medium may flow, organized normal to an axis of traction, whereby the axis of traction is the axis along which the invented device reduces length as the compressed medium is introduced into the reservoir.

In an alternate embodiment of the invented method, one or more bladders of the flexible, inelastic material are woven through two or more strips or strings, also composed of the same or a similar flexible but inelastic material, wherein the bladders may optionally be substantively tubular in shape. The strips or strings preferably run in parallel to one another. The bladders are adapted to receive the preferably compressed gaseous or liquid medium. As the compressed medium is moved into the bladders, the flexible strips or stings are deformed to cause the strips or strings to have a reduced length along the axis of traction.

In a yet further alternate embodiment of the invented method, a textile tissue is used in place of the above-mentioned strips. In this case, two pieces of textile are connected to each other by means of a plurality of stitches. In this embodiment, the bladders are standalone, in a similar way to that of the strips. The stitches are preferably positioned between the bladders along the length of the strips. This embodiment is intended mostly for heavy-weight loading, because the greater strength of the textile tissue enables operation with even very heavy loads.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE FIGURES

These, and further features of the invention, may be better understood with reference to the accompanying specification and drawings depicting the preferred embodiment, in which:

FIG. 1A is an overhead view of the invented device when the invented device is in an extended position, having an empty reservoir portion;

FIG. 1B is an overhead view of the invented device when a compressed medium has been introduced into the reservoir, substantively filling the reservoir;

FIG. 1C is an overhead view of the invented device when the invented device is in an extended position, and wherein the invented device is composed of a textile material;

FIG. 2A is a side view of the invented device when the invented device is extended;

FIG. 2B is a side view of the invented device when a compressed medium has been introduced into the chamber, and the elongate chambers are shown to be distended;

FIG. 2C is a detailed side view of an exemplary first elongate chamber, shown in the extended position, and having a lateral length S;

FIG. 2D is a detailed side view of the exemplary first elongate chamber, shown in the filled position, and having a lateral length of 2/PI S, and a curved extension S;

FIG. 3A is a side view of the die process of the invented device, wherein the top and bottom of the invented device are both imprinted with a designated pattern of chambers;

FIG. 3B is a further side view of the die process of the invented device, wherein only top of the invented device is imprinted with a designated pattern of chambers;

FIG. 3C is a top view of the die process of the invented device;

FIG. 3D is a bottom view of the die process of the invented device;

FIG. 4 is a top view of the invented device, wherein the invented device contains multiple reservoir ports for the introduction and/or removal of a compressed medium;

FIG. 5A shows an alternate embodiment of the invented device, wherein a piston chamber is attached to the reservoir of the invented device of FIG. 1A, allowing for highly regulated introduction and/or removal of the compressed medium;

FIG. 5B shows another alternate embodiment of the invented device of FIG. 5A, wherein a membrane chamber is attached to the reservoir of the invented device of FIG.

1A, wherein the membrane device enables highly regulated introduction and/or removal of the compressed medium;

FIG. 5C shows the alternate embodiment of the invented device of FIG. 5B, wherein the compressed medium is shown flowing from within the membrane device in a different direction than as indicated in FIG. 5B;

FIG. 6 is a block diagram of the internal control mechanism of the invented device;

FIG. 7A is side view of an alternate embodiment of the invented device shown in an extended position, whereby a plurality of bladders are interwoven with two or more flexible strands;

FIG. 7B is a side view of the alternate embodiment of the invented device as shown in FIG. 7A, wherein the plurality of bladders interwoven with two or more flexible strands are substantively filled with a compressed medium;

FIG. 7C is a top view of the alternate embodiment of the invented device of FIG. 7A in the same extended position of FIG. 7A;

FIG. 7D is a top view of the alternate embodiment of the invented device of FIG. 7A in the same state of bladders filled with a compressed medium of FIG. 7B;

FIG. 7E is a side view of an additional alternate embodiment of the invented device, wherein two sheets of textile material are stitched together to partially enclose the bladders of FIG. 7A and shown in the extended position of FIG. 7A;

FIG. 7F is a side view of the additional alternate embodiment of the invented device as shown in FIG. 7E, wherein the plurality of bladders are substantively filled with a compressed medium;

FIG. 7G is a top view of the additional alternate embodiment of the invented device of FIG. 7E in the extended position of FIG. 7A; and FIG. 7H is a top view of the additional alternate embodiment of the invented device of FIG. 7E in the same state of bladders filled with a compressed medium of FIG. 7B.

DETAILED DESCRIPTION

Referring now generally to the Figures and particularly to FIG. 1A, FIG. 1A is an overhead view of the invented device 100 when the invented device 100 is extended, i.e. when a reservoir 102 is not filled with a medium 104, such as an uncompressed liquid, a compressed gas or a compressed liquid. In the extended position, the reservoir 102 portion of the invented device has a length LA. The length LA of the invented device 100 describes the length along a traction x axis 106 of the invented device 100 when the invented device 100 is in the extended position. The traction x axis 106 of the invented device 100 is the axis along which the invented device 100 contracts and expands when the medium 104 is introduced and removed therefrom, respectively. The invented devices 100 comprises a top sheets 100A and a bottom sheet 100B comprising a flexible but inelastic material, sealed together along a device periphery 100C of the two sheets 100A & 100B of material forming an internal reservoir 108 into which medium 104 may be introduced. The flexible but inelastic material of which each sheet 100A & 100B may be or comprise polyvinyl chloride, urethane plastic, biaxially oriented polyester such as polyethylene terephthalate ("PET"), fiber reinforced polyurethane, fiber reinforced polyester, fiber reinforced nylon, KEVLAR™ para-aramid synthetic fiber marketed by Dupont of Wilmington, Del., DYNEEMA™ super-strong fiber made from Ultra-High Molecular Weight Polyethylene (UHMwPE) as marketed by DSM Dyneema LLC of Stanley, N.C., or other suitable inelastic and flexible material known in the art. The reinforcing fiber of the sheets 100A & 100B may be or comprise highly oriented polymer fiber made of KEVLAR™ para-aramid synthetic fiber marketed by Dupont of Wilmington, Del., DYNEEMA™ super-strong fiber made from Ultra-High Molecular Weight Polyethylene (UHMwPE) as marketed by DSM Dyneema LLC of Stanley, N.C., or other suitable inelastic and flexible material known in the art.

The flexible but inelastic material is further sealed by internal barriers 110 which may block air flow between distinct chambers 112 of the invented device 100, which chambers 112 are elongate within the device 100, and are substantively normal to the traction x axis 106. Further within the reservoir 108 of the invented device 100 exist apertures 114 which allow limited flow of gas, e.g. air, between the elongate chambers 112. Positioned along the periphery of the reservoir 108 are preferably one or more valves 116 through which the medium 104 may be controllably introduced and/or removed.

The internal barriers 110 and the device periphery 100C may be formed by, suitable methods known in the art that include aspects such as, but not limited to, (a.) application of pressure against the top sheet 100A and/or the bottom sheet 100B, (b.) a.) application of heat against the top sheet 100A and/or and the bottom sheet 100B, and/or (c.) application and inclusion of an adhesive (not shown). Alternatively or additionally, a portion or all of the reservoir 102, the device periphery 100C, sheets 100A & 10B and/or internal barriers 110 may be formed by application of 3d printing methods and systems.

A first anchor feature 118 and a second anchor feature 120 are separately positioned distal along the traction x axis 106 of the invented device 100. At least one of the anchor features 118-120 may preferably be moved under direction from a force along the traction x axis 106 of the invented device 100, or optionally both the first anchor feature 118 and the second anchor feature 120 may be moved under direction from a force along the traction x axis 106 of the invented device 100. The first anchor feature 118 preferably comprises one or more loops 122 made of a durable, inflexible material, the loops of the first anchor feature 118 detachably coupling to a first anchor 118 attachment assembly 124. The first anchor attachment assembly 118 preferably comprises one or more hooks 126 composed of a durable, inflexible material, which one or more hooks 126 may be detachably coupled with the loops 122 of the first anchor feature 118. The one or more hooks 126 of the first anchor 118 attachment assembly 124 are attached to a first mechanism which may exert a force on the distal ends of the invented device 100. The second anchor feature 120 preferably also comprises one or more loops 128 made of a durable, inflexible material, the loops 128 of the second anchor feature 120 detachably coupling to a second anchor 120 attachment assembly 130. The second anchor 120 attachment assembly 130 preferably comprises one or more hooks 132 composed of a durable, inflexible material, which one or more hooks 132 may be detachably coupled with the loops 128 of the second anchor feature 120. The one or more hooks 132 of the second anchor 120 attachment assembly 130 are attached to a second mechanism which may exert a force on the distal ends of the invented device 100.

Referring now generally to the Figures and particularly to FIG. 1B, FIG. 1B is an overhead view of the invented device 100 when the medium 104 has been introduced into the reservoir 108, and the reservoir 108 is substantively filled. In the filled position, the reservoir 108 portion of the invented device has a length 2/PI LA. FIG. 1B shows the reservoir 108, elongate chambers 112, traction x axis 106, one or more valves 116, and first and second anchor feature attachment assemblies 124 and 130 of FIG. 1A, wherein the medium 104 has been introduced into the reservoir 108, substantively filling the reservoir 108. When the medium 104 is introduced into the reservoir 108, the length LA of the reservoir 108 has been reduced, without substantively reducing the surface area of the reservoir 108. The elongate chambers 112 of the invented device 100 require substantively less medium 104 for filling the reservoir 108 than the reservoir 108 would necessitate should the reservoir 108 simply be sealed along the edges thereof, creating an uninterrupted chamber into which the medium 104 may be introduced. The reduced amount of medium 104 allows for shorter response times for contracting and releasing tension along the length LA of the reservoir 108. The allowance of the elongate chambers 112 for more significant contraction of the reservoir 108, without reduction of the surface area of the reservoir 108, exerts a strong tensile force on the first and second anchor attachment assemblies 124 and 130. The reservoir 108 may contract to 2/PI LA (as shown in the Figure), some fraction having a value greater than 2/PI LA, but a lesser value than LA, or some fraction having a value less than 2/PI LA.

Referring now generally to the Figures and particularly to FIG. 1C, FIG. 1C is a top view of an alternate invented textile device 145, wherein a textile embodiment of the invented device 145 is in an extended position, and wherein a pair of textile sheets 142-144 are composed of a textile material. The two textile sheets 142 and 144 form the reservoir 108 of the invented textile device 145 and are preferably sealed together by means of stitching 131. The elongate chambers 112 of the invented textile device 145 are also preferably sealed in place by means of the stitching 131.

Referring now generally to the Figures and particularly to FIG. 2A, FIG. 2A is a side view of the invented device 100 when the invented device 100 is extended. It is shown that the elongate chambers 112 appear substantively evenly spaced apart within the reservoir 108, and substantively normal to the traction x axis 106 of the invented device 100. The elongate chambers 112 of the reservoir 108 are further shown as they would appear when not filled with the medium 104, allowing the two sheets 100A & 100B of flexible, inelastic material to rest substantively parallel to one another, and not exerting a tensile force on the first and/or second anchor attachment assemblies 124 and 130. In this Figure, the reservoir 108 has a length LA.

Referring now generally to the Figures and particularly to FIG. 2B, FIG. 2B is a side view of the invented device 100 when a medium 104 has been introduced into the reservoir 108, and the reservoir 108 is substantively filled. The medium 104 is shown to have been introduced into the elongate chambers 112 of the reservoir 108, the medium 104 having been introduced through one or more of the valves 116 along the periphery of the reservoir 108, and having been allowed to flow through the reservoir 108, in the apertures 114 between the elongate chambers 112. The length of the reservoir 108 is shown to have been reduced to approximately 2/PI LA, without substantively reducing surface area of the reservoir 108, creating a tensile force on the first and/or second anchor attachment assemblies 124 and 130.

Referring now generally to the Figures and particularly to FIG. 2C, FIG. 2C is a detailed side view of an exemplary first elongate chamber 112, shown in the extended position, and having a chamber length LA along a traction x axis 106. Each of the elongate chambers 112 preferably displays a substantively equal chamber length LA.

Referring now generally to the Figures and particularly to FIG. 2D, FIG. 2D is a detailed side view of the exemplary first elongate chamber 112, shown in the filled position, and having a chamber length 2/PI LA along the traction x axis 106, and a curved extension LA. The elongate chamber 112 is shown being substantively full of the medium 104. The chamber length of the elongate chamber 112 is shown to be approximately 2/PI LA, as compared to the chamber length LA of the unfilled elongate chamber 112 of FIG. 2C, and a curved extension of approximately LA on the distended portion of the elongate chamber 112. FIG. 2D demonstrates the contraction of the length of the reservoir 108, without loss of surface area, allowing for a tensile force to be exerted on the first and/or second anchor attachment features 124 and 130 along the traction x axis 106 of the invented device 100.

It is understood that according to the method of the present invention, the formation and application of two or of a plurality of elongate chambers 112 enables the invented device 100, versus the application of a single elongate chamber 112, to contract and expand along the traction x axis as the medium 104 is respectively inserted into and withdrawn from the elongate chambers 112, while reducing the amount of expansion required of the invented device 100 along the two geometric Y & Z axes that are orthogonal to the traction axes. In addition, it is understood that given a constant surface area of both the top sheet 100A and the bottom sheet 100B, less medium 104 is required to generate the same degree of contraction of the invented device 100 along the traction x axis as the number of elongate chambers 112 is increased as less expansion of the invented device 100 along the Y axis is required.

Referring now generally to the Figures and particularly to FIG. 3A, FIG. 3A is a side view of the die process of the invented device 100, wherein the top 134 and bottom 136 of the reservoir 108 of the invented device 100 are both imprinted with a designated pattern of chambers 138 and 140, creating the elongate chambers 112 within the reservoir 108. In the first preferred die process for the invented device 100, the top die 138 and the bottom die 140 preferably bear a designated pattern of chambers 141, whereby the pattern of chambers may be imprinted into the top sheet 100A and the bottom sheet 144 of the flexible but inelastic material, such that the chambers 112 are formed and sealed substantively between the top sheet 100A and the bottom sheet 144. This allows for a strong seal between the two sheets 100A and 144, and for the distention of both the top 134 and bottom 136 portions of each elongate chamber 112, rather than limiting the distention to one or the other. The edges of the top sheet 100A and the bottom sheet 144 may also be sealed together in this process.

Referring now generally to the Figures and particularly to FIG. 3B, FIG. 3B is a further side view of an alternate die process of the invented device 100, wherein only top of the reservoir 108 of invented device 100 is imprinted with a designated pattern of chambers 141, creating the elongate chambers 112 within the reservoir 108. In this second preferred die process for the invented device 100, only the top die 138 bears a designated pattern of chambers, whereby the pattern of chambers 141 may be imprinted into the top sheet 100A, and such that the chambers 112 are formed by sealing between the top sheet 100A to the bottom sheet 144. This allows for a simpler die process. The edges of the top sheet 100A and the bottom sheet 144 may also be sealed together in this process.

Referring now generally to the Figures and particularly to FIG. 3C, FIG. 3C is a view of the top die 138 for the creation of the invented device 100, showing a preferred pattern of elongate chambers 141 to be stamped into the reservoir 108 of the invented device 100.

Referring now generally to the Figures and particularly to FIG. 3D, FIG. 3D is view of bottom die 140 for the creation of the invented device 100, showing a preferred pattern of elongate chambers 141 to be stamped into the reservoir 108 of the invented device 100.

Referring now generally to the Figures and particularly to FIG. 4, FIG. 4 is a top view of the invented device 100, wherein the invented device 100 contains multiple reservoir ports 116 for expedited and/or more controlled introduction and/or removal of the medium 104. The greater number of ports 116 allows a user more refined control over the introduction and/or removal of the medium 104, because the chambers 112 within the invented device 100 restrict the flow of the medium 104; thus, more ports 116 along a the periphery of the reservoir 108 allow a user to bypass the need to wait for the amount of the medium 104 within the reservoir 108 to equalize throughout the reservoir 108 before determining the pressure level. By using ports 116 along the whole distance of the reservoir 108, the user may introduce a substantively equal amount of the medium 104 into the reservoir 108 more quickly than the user would be able to do accomplish with only one or two valve ports 116.

Referring now generally to the Figures and particularly to FIG. 5A, FIG. 5A shows an alternate embodiment of the invented device 100, wherein a pump 146 is attached to the reservoir 108 of the invented device 100, allowing for highly regulated introduction and removal of the medium 104. The pump 146 may contain a designated amount of the medium 104, which may be introduced and/or removed from the reservoir 108 with enhanced precision by a user via one or more ports 116 equipped with two way valve 148 along the periphery of the reservoir 108.

It is understood that the pump 146 may be or comprise a AAA SERIES MICRO DIAPHRAGM AIR PUMP (235-1410 CC/MIN)™ air pump as marketed by Sensidyne, LP of St. Petersburg, Fla., or other suitable air or liquid pump known in the art.

Referring now generally to the Figures and particularly to FIG. 5B, FIG. 5B shows an alternate embodiment of the invented device 100, wherein a membrane chamber 150 is attached to the reservoir 108 of the invented device 100, allowing for highly regulated introduction and removal of the medium 104. The membrane chamber 150 may contain a designated amount of the medium 104, which may be introduced and/or removed from the reservoir 108 with enhanced precision by a user via two or more ports 116 equipped with two way valves 148 along the periphery of the reservoir 108.

Referring now generally to the Figures and particularly to FIG. 5C, FIG. 5C shows an alternate embodiment of the invented device 100, wherein the membrane chamber 150 is attached to the reservoir 108 of the invented device 100, allowing for highly regulated introduction and removal of the medium 104. The membrane chamber 150 may contain a designated amount of the medium 104, which may be introduced and/or removed from the reservoir 108 with enhanced precision by a user via two or more ports 116 equipped with two way valves 148 along the periphery of the reservoir 108. FIG. 5C shows the compressed medium flowing in the opposite direction within the membrane chamber to that of FIG. 5B.

Referring now generally to the Figures and particularly to FIG. 6, FIG. 6 is a block diagram of the internal control mechanism 600 of the invented device 100. The internal control mechanism 600 of the invented device 100 contains a signal and power bus 602 that is bi-directionally communicatively coupled with: a central processing unit ("CPU") 604; a memory 606; a pump system 608; a logic 610; a power source 612; a plurality of valves 614; and a sensor 116.

Referring now generally to the Figures and particularly to FIGS. 7A through 7D, FIG. 7A is a side view of an alternate embodiment of the invented device 700, whereby a plurality of bladders 702 having a bladder elongate central axis 703 (hereinafter "bladder axis 703"), are interwoven with two or more flexible strands 704, made of a flexible but inelastic material, shown in an extended position. It is understood that the bladder elongate central axis 703 is normal to the traction axis 710.

One or more of the bladders 702 may be substantively tubular in shape and/or comprise polyvinyl chloride, urethane plastic, biaxially oriented polyester such as PET, fiber reinforced polyurethane, fiber reinforced polyester, fiber reinforced nylon, KEVLAR™ para-aramid synthetic fiber marketed by Dupont of Wilmington, Del., DYNEEMA™ super-strong fiber made from Ultra-High Molecular Weight Polyethylene (UHMwPE) as marketed by DSM Dyneema LLC of Stanley, N.C., more other suitable inelastic and flexible material known in the art. The reinforcing fiber of one or more bladders 702 may be or comprise glass fibers, and/or highly oriented polymer fiber and/or other suitable flexible and inelastic fiber known in the art. In addition, one or more bladders may be or comprise a flexible and elastic material, such as latex, silicone or other suitable flexible and elastic material known in the art. The flexible but inelastic material of which the strands 704 are composed may be or comprise polyvinyl chloride, urethane plastic, biaxially oriented polyester such as polyethylene terephthalate ("PET"), fiber reinforced polyurethane, fiber reinforced polyester, fiber reinforced nylon, or other suitable inelastic and flexible material known in the art. The reinforcing fiber of the strands 704 may be or comprise KEVLAR™ para-aramid synthetic fiber marketed by Dupont of Wilmington, Del., DYNEEMA™ super-strong fiber made from Ultra-High Molecular Weight Polyethylene (UHMwPE) as marketed by DSM Dyneema LLC of Stanley, N.C., or other suitable flexible and inelastic fiber known in the art.

The bladders 702 each preferably contain or be coupled with one or more valves 148, through which the medium 104 may be introduced or removed.

The termini of the two or more flexible but inelastic strands 704 are coupled with a first strand anchor hook 706 and/or a strand second anchor hook 708, which are separately positioned distal on the flexible strands 704. The first strand anchor hooks 706 are coupled at a first object 712 at a first anchor feature 714 and the second strand anchor hooks 708 are coupled to a second object 716 at a second anchor feature 718.

Referring now generally to the Figures and particularly to FIG. 7B, FIG. 7B is a side view of the alternate embodiment of the invented device as shown in FIG. 7A, whereby the plurality of bladders 702 interwoven with two or more flexible strands 704 are substantively filled with the medium 104. It is understood that the medium 104 may have been pumped under pressure into the bladders 104 by the pump 146 or membrane chamber 150 or other suitable means known in the art to deliver compressed gas or liquid into the bladders 104.

When the medium 104 has been introduced into the flexible but inelastic bladders 702, the bladders exert a force on the flexible strands 704, forcing the strands 704 to become curved thus reducing effective length along the traction x axis 710, but not expanding the surface area of the flexible strands 704, thus exerting a tensile force on the first and/or the second strand anchor attachment assembly 714 and/or 720 normal to the bladder axis 703. As the bladders 702 become more substantively filled, the bladders exert greater force on the strands 704, forcing the strands 704 to decrease in relative length, thus exerting a greater force on the first and/or second strand anchor attachment assembly 714 and/or 720.

Referring now generally to the Figures and particularly to FIGS. 7A through 7D, FIG. 7C is a top view of the alternate embodiment of the invented device of FIG. 7A in the same extended position of FIG. 7A, wherein the bladders 702, each having the bladder axis 703 normal to the traction x axis 710, and each bladder 702 having a two-way valve 148 through which a medium 104 may be introduced and/or removed from the bladders 702. Woven between the bladders 702 are two flexible strands 704, the flexible strands 704 being coupled to the first strand anchor attachment assembly 714 and the second strand anchor attachment assembly 720 by means of the first strand anchor loop 706 and the second strand anchor loop 708, respectively.

Referring now generally to the Figures, and particularly to FIG. 7D, FIG. 7D is a top view of the device 700 of FIG. 7A, showing the bladders 702, each having the bladder axis 703 normal to the traction x axis 710, and each bladder 702 having a two-way valve 148 through which a medium 104 may be introduced and/or removed from the bladders 702. Woven between the bladders 702 are two flexible strands 704, the flexible strands 704 being coupled to the first strand anchor attachment assembly 714 and the second strand anchor attachment assembly 720 by means of the first strand anchor loop 706 and the second strand anchor loop 708, respectively, and the loops 712 and 718 connecting to the two or more hooks 716 and 722, respectively. FIG. 7D shows the bladders 702 substantively filled with medium 104, whereby the bladders exert force on the strands 704, forcing the strands 704 to decrease in relative length, thus exerting a greater tensile force on the first object 712 and the second object 716.

Referring now generally to the Figures and particularly to FIGS. 7E through 7H, FIG. 7E is a side view of an additional alternate embodiment of the invented device 724 (hereinafter, "sheet device" 724), wherein two sheets of textile material 726 are stitched together by stitching 728 to partially enclose the bladders 702 of FIG. 7A and shown in the extended position of FIG. 7A. The sheets of textile material 726 preferably inelastic along the traction axis 710 and may be or comprise inelastic KEVLAR™ para-aramid synthetic fiber marketed by Dupont of Wilmington, Del., DYNEEMA™ super-strong fiber made from Ultra-High Molecular Weight Polyethylene (UHMwPE) as marketed by DSM Dyneema LLC of Stanley, N.C., or other suitable flexible and inelastic fiber known in the art, wherein the inelastic fibers extend in their elongate length dimension substantively in parallel to the traction axis 710. The stitching 728 preferably comprises an inelastic fiber, such as KEVLAR™ para-aramid synthetic fiber marketed by Dupont of Wilmington, Del., DYNEEMA™ super-strong fiber made from Ultra-High Molecular Weight Polyethylene (UHMwPE) as marketed by DSM Dyneema LLC of Stanley, N.C., or other suitable flexible and inelastic fiber known in the art. It is noted the relatively empty bladders 702 are shown in FIG. 7E to be flattened by the weight of the sheets 726.

Referring now generally to the Figures and particularly to FIGS. 7E through 7H FIG. 7F is a side view of the sheet device 724 as shown in FIG. 7E, wherein the plurality of bladders 702 are substantively filled with the medium 104 and the sheets 726 receive a force from the bladders 104 to shorten the length of the linear extension of the sheets 726 along the traction axis 710.

Referring now generally to the Figures and particularly to FIGS. 7E through 7H FIG. 7G is a top view of the sheet device 724 in the extended position of FIG. 7E, wherein the bladders 702 are shown to be flattened by the weight of the sheets 726.

Referring now generally to the Figures and particularly to FIGS. 7E through 7H FIG. 7H is a top view of the sheet device 724 in the same state of bladders 702 filled with the medium 104.

Additional optional preferred embodiments of the present invention may include one or more of the following elements. The anchor features 118 and 120 and/or strand anchor features 706 and 708 may be or comprise metal holding rods, wherein the metal holding rods preferably have a plastic coating in order to prevent damage to the two or more flexible strands 704. The bladders 702 may optionally be presented in array of 128 bladders, and may optionally be comprised of plastic tubes, and each bladder 702 may preferably be closed on one side thereof and connected to a flexible manifold on the other side; flexibility of the manifold is significant because a "muscle" is contracting, which substantively changes the geometry of the manifold. The manifold additionally preferably contains at least two valves 116, 148, or 614, wherein at least one of the valves 116, 148, or 614 is an inlet and at least one of the valves 116, 148, or 614 is an outlet. The inlet preferably connects to a pump system 608, which additionally preferably attaches to a battery, and the outlet preferably disposes of air or other compressed medium into the atmosphere when a "muscle" (i.e. the device 100, 700, or 724) needs to be released.

The strands 704 may optionally or additionally be formed by one or more threads, wherein the threads preferably overlap every bladder. The threads extend from the plastic-coated metal holding rod, and extend between riddle rods and between riddle strips. The riddle is necessary to maintain a preferred shape for a bladder 702 array. During an assembly process each strand 704 is preferably put into place after finishing in order to form an appropriate layer by passing thread over each of the bladders 702.

In a further optional preferred embodiment of the present invention, the "muscle" may optionally have a single woven layer, wherein the single woven layer of muscle preferably comprises the following elements. Two metal holding rods, preferably having plastic coating to prevent damage to the strands 704, having an array of preferably ten bladders 702 extending therebetween. Each bladder 704 preferably connects to a flexible manifold on one end of the bladder 704, and is preferably substantively sealed on the other end; the manifold is preferably flexible such that the geometry of the manifold may be adjusted upon contraction of the muscle without damage to the manifold or to the muscle. The manifold preferably additionally contains at least two valves 116, 148, or 614, wherein at least one of the valves is an inlet, which is preferably connected to a pump system 608 for inserting air into the bladders 704 of the device/muscle 700, and at least one of the valves 116, 148, or 614 is an outlet, for removing air from the bladders 704 when the muscle/device 700 needs to be released. The pump system 608 preferably additionally connects to a battery. In the instant preferred embodiment of the present invention, a plurality of strings are formed by one or more threads. This thread preferably overlaps every bladder 704 of the array of bladders 704. The thread begins at one of the plastic-coated metal holding rod, then overlaps a riddle rod between two washers, wherein the washers maintain a desired shape for the bladder array. The thread additionally preferably overlaps alternative bladders, and extends again to another riddle rod between washers and reaches another holding rod.

In a yet further optional preferred embodiment of the present invention, a printed muscle/device 700 is presented. The printed muscle/device first preferably includes two metal holding rods, which are imprinted between two plastic sheets, wherein an array of preferably between ten and twelve bladders 704 are formed within the two plastic sheets by means of stitches placed in the plastic sheets at designated spatial intervals preferably by a sewing machine. The bladders 704 placed most proximate to each of the metal holding rods each preferably contain a single valve 116, 148, or 614, wherein at least one of the valves is an inlet, which is preferably connected to a pump system 608, and at least one of the valves 116, 148, or 614 is an outlet, for removing air from the bladders 704 when the muscle/device 700 needs to be released. Each of the bladders 704 not most proximate to one of the metal holding rods is sealed on either distal end, and is connected within the plastic sheets to the bladders 704 by means of breaks the stitching pattern, such that the compressed medium introduced via the inlet may be distributed evenly between the bladders 704 within the plastic sheets. The bladders 704 within the plastic sheeting are sufficient for a weak muscle, but when significant forces are necessary, strings may be added by means of vertical holes within the stitches.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible configurations or aspects of the Present Invention. The examples given should only be interpreted as illustrations of some of the preferred configurations or aspects of the Present Invention, and the full scope of the Present Invention should be determined by the appended claims and their legal equivalents. Those skilled in the art will appreciate that various adaptations and modifications of the just-described preferred embodiments can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

I claim:

1. An apparatus coupled with a first object and a second object, the first object and the second object displaced along a traction axis, the apparatus comprising:

a tensile element comprising a first tensile sheet coupled with a second tensile sheet, wherein at least one tensile sheet comprises at least two substantively inelastic elongate strands ("strands") wherein at least one strand of the at least two strands comprises a first strand end and a second strand end, and the first strand end is coupled to the first object and the second strand end is coupled to the second object;

the first tensile sheet being substantively inelastic along the traction axis;

the second tensile sheet being substantively inelastic along the traction axis, and the second tensile sheet attached to the first tensile sheet by internal barriers that form a plurality of chambers between the two tensile sheets, each chamber comprising a first tensile sheet portion of the first tensile sheet coupled with a second tensile sheet portion of the second tensile sheet, wherein each chamber has at least one aperture and the two tensile sheets in combination form a first end and a second end of the apparatus;

the first end of the apparatus coupled with the first object;

the second end of the apparatus coupled with the second object; and the plurality of chambers adapted to accept a medium under pressure via the chamber apertures and thereby deliver a force component perpendicular to the traction axis and displacing the two tensile sheet portions of at least one of the plurality of chambers containing the medium under pressure, whereby the force component is transferred from the medium under pressure to the two tensile sheets and causes the apparatus to pull the first object and the second object towards each other along the traction axis.

2. The apparatus of claim 1, wherein at least one tensile sheet comprises a plurality of substantively inelastic elongate strands ("strands"), and each strand of the plurality of strands each comprise a first strand end and a second strand end, and wherein each first strand end is coupled to the first object and each second strand end is coupled to the second object.

3. The apparatus of claim 1, wherein the compressed medium is in a gaseous state.

4. The apparatus of claim 1, wherein the compressed medium is in a liquid state.

5. The apparatus of claim 1, further comprising a sealed reservoir that includes the plurality of chambers and a two way valve, wherein the reservoir is adapted to partially contain the compressed medium and the two way valve is coupled with the reservoir and two way valve alternately inhibits the compressed medium from entering or exiting the sealed reservoir.

6. An apparatus coupled with a first object and a second object, the first object and the second object displaced along a traction axis, the apparatus comprising:

a first tensile sheet;

a second tensile sheet coupled with the first tensile sheet to form a sealed reservoir having internal barriers that form a plurality of chambers and a plurality of internal apertures disposed within the sealed reservoir, each chamber comprising a first tensile sheet portion of the first tensile sheet coupled with a second tensile sheet portion of the second tensile sheet, and each of the plurality of internal apertures formed between at least two internal barriers to enable a medium to flow between at least two chambers, and wherein the first tensile sheet and the second tensile sheet are each substantively inelastic along the traction axis;

at least one valve extending into the sealed reservoir through which a medium is introduced into a first chamber of the plurality of chambers, whereby the medium passes from the first chamber and into additional chambers of the plurality of chambers through at least two internal apertures;

a first end of the apparatus coupled with the first object; and a second end of the apparatus coupled with the second object, and the plurality of chambers adapted to accept the medium under pressure via the internal apertures and thereby deliver a force component perpendicular to the traction axis and displacing the two tensile sheet portions of at least one of the plurality of chambers containing the medium under pressure, whereby the force component is transferred from the medium under pressure to cause the apparatus to pull the first object and the second object towards each other along the traction axis.

7. A method comprising:

a. Coupling the apparatus of claim 6 to the first object and the second object along a traction axis; and b. Forcing the medium into the plurality of chambers, each chamber adapted and positioned to deliver pressing forces toward the strand as the medium is forced into the bladder, wherein pressing forces is normal to the traction axis, whereby the pressing forces when applied to the two tensile sheets causes the two tensile sheets to deliver a tensile force to both the first object and the second object along the traction axis.

8. The method of claim 7, wherein the medium is in a gaseous state.

9. The method of claim 7, wherein the medium is in a liquid state.

10. The apparatus of claim 6, wherein the compressed medium is at least partly in a gaseous state.

11. The apparatus of claim 6, wherein the compressed medium is a least partly in a liquid state.

12. The apparatus of claim 6, wherein the valve is a two way valve and the sealed reservoir is adapted to accept the compressed medium, whereby the two way valve alternately inhibits the compressed medium from entering or exiting the sealed reservoir.

13. The apparatus of claim 6, wherein the valve may be optionally coupled to a means for introducing the compressed medium into the reservoir.

14. The apparatus of claim 13, wherein the means for introducing the compressed medium is into the reservoir is a pump.

15. The apparatus of claim 13, wherein the means for introducing the compressed medium is into the reservoir comprises a pump.

16. The apparatus of claim 13, wherein the pump is adapted to introduce a medium that includes a liquid into the reservoir.

17. The apparatus of claim 13, wherein the pump is adapted to introduce a medium that includes a gas component into the reservoir.

* * * * *